US010532480B2

(12) United States Patent
Fastabend et al.

(10) Patent No.: US 10,532,480 B2
(45) Date of Patent: Jan. 14, 2020

(54) SLICER WITH BLADE SUPPORTS

(71) Applicant: Prince Castle LLC, Carol Stream, IL (US)

(72) Inventors: Mark Fastabend, Chicago, IL (US); Eugene S. Maslana, Arlington Heights, IL (US); Eric Larson, Pecatonica, IL (US); Scott R. Hammac, Joliet, IL (US)

(73) Assignee: Prince Castle LLC, Carol Stream, IL (US)

( * ) Notice: Subject to any disclaimer, the term of this patent is extended or adjusted under 35 U.S.C. 154(b) by 288 days.

(21) Appl. No.: 15/467,633

(22) Filed: Mar. 23, 2017

(65) Prior Publication Data

US 2017/0190066 A1 Jul. 6, 2017

Related U.S. Application Data

(63) Continuation-in-part of application No. 15/267,730, filed on Sep. 16, 2016, now abandoned, and a (Continued)

(51) Int. Cl.
*B26D 5/00* (2006.01)
*B26D 1/03* (2006.01)

(Continued)

(52) U.S. Cl.
CPC ..... *B26D 1/03* (2013.01); *B26D 7/0608* (2013.01); *B26D 7/225* (2013.01); *B26D 5/18* (2013.01);

(Continued)

(58) Field of Classification Search
CPC . Y10T 83/8831; Y10T 83/885; Y10T 83/883; B26D 5/18; B26D 5/083

(Continued)

(56) References Cited

U.S. PATENT DOCUMENTS 2,563,237 A 6/1947 Grocoff
D164,693 S 10/1951 Kooas (Continued)

FOREIGN PATENT DOCUMENTS

DE 29621638 10/1997
DE 102004002070 8/2005

(Continued)

OTHER PUBLICATIONS

Edlund, Manual Fruit & Vegetable Slicer, 2014.

(Continued)

*Primary Examiner* — Reginald Alexander
(74) *Attorney, Agent, or Firm* — Andrus Intellectual Property Law, LLP

(57) ABSTRACT

An blade assembly for use with a produce slicer includes a first blade set having a first pair of opposing frame bars and a plurality of blades extending between the first pair of opposing frame bars, a blade cover positioned relative to the first blade set, and a blade support extending from the first target ring to support the plurality of blades. The blade cover includes a planar top portion having a first target ring that defines a first target area through which a piece of produce passes during slicing.

16 Claims, 13 Drawing Sheets

Related U.S. Application Data continuation-in-part of application No. 14/833,744, filed on Aug. 24, 2015, now Pat. No. 9,914,229.

(60) Provisional application No. 62/221,363, filed on Sep. 21, 2015, provisional application No. 62/117,222, filed on Feb. 17, 2015, provisional application No. 62/043,918, filed on Aug. 29, 2014.

(51) Int. Cl.

| | |
|---|---|
| ***B26D 7/06*** | (2006.01) |
| ***B26D 7/22*** | (2006.01) |
| *B26D 7/00* | (2006.01) |
| *B26D 5/18* | (2006.01) |

(52) U.S. Cl.

CPC .. *B26D 2007/0018* (2013.01); *B26D 2210/02* (2013.01); *Y10T 83/883* (2015.04); *Y10T 83/885* (2015.04); *Y10T 83/8831* (2015.04)

(58) Field of Classification Search

USPC .... 83/858, 620, 630, 633, 932; 30/114, 299, 30/302, 304

See application file for complete search history.

(56) References Cited

U.S. PATENT DOCUMENTS

| | | | | | |
|---|---|---|---|---|---|
| 2,836,212 | A | | 5/1958 | Albert | |
| 2,916,986 | A | | 12/1959 | Levovitz | |
| 3,112,781 | A | * | 12/1963 | Popeil | A47J 19/00 83/425.2 |
| 3,369,582 | A | | 2/1968 | Giangiulio | |
| 3,463,211 | A | | 8/1969 | Holz | |
| 3,605,839 | A | | 9/1971 | Gerson | |
| 3,924,501 | A | | 12/1975 | Cohen et al. | |
| 4,059,037 | A | | 11/1977 | Gerson et al. | |
| 4,062,260 | A | * | 12/1977 | Steinhogl | B26B 5/008 83/404.3 |
| 4,254,678 | A | | 3/1981 | Novy et al. | |
| 4,302,997 | A | | 12/1981 | Jones et al. | |
| 4,436,011 | A | | 3/1984 | Jones | |
| 4,453,458 | A | | 6/1984 | Altman | |
| 4,567,801 | A | | 2/1986 | Jones | |
| 4,573,384 | A | | 3/1986 | Jones | |
| 4,579,028 | A | | 4/1986 | Neidhardt | |
| D297,798 | S | | 9/1988 | Leung | |
| 4,870,719 | A | | 10/1989 | Harris | |
| 5,245,902 | A | | 9/1993 | Pereira | |
| 5,343,623 | A | * | 9/1994 | Cole | B26D 1/0006 30/299 |
| 5,419,245 | A | | 5/1995 | Short | |
| 5,613,903 | A | | 3/1997 | Fujitaki et al. | |
| 5,749,145 | A | | 5/1998 | Baukloh | |
| D400,065 | S | | 10/1998 | Fohrman | |
| 6,041,682 | A | | 3/2000 | Jenson et al. | |
| D505,302 | S | | 5/2005 | Veltrop et al. | |
| D531,465 | S | | 11/2006 | Tellier | |
| 8,495,941 | B2 | | 7/2013 | Faird et al. | |
| 2006/0185488 | A1 | | 8/2006 | Short et al. | |
| 2006/0225547 | A1 | * | 10/2006 | Stanojevic | B26D 1/553 83/13 |
| 2009/0249935 | A1 | | 10/2009 | Kaposki | |
| 2010/0031830 | A1 | | 2/2010 | Engdahl et al. | |
| 2010/0313724 | A1 | | 12/2010 | Faird et al. | |
| 2011/0283549 | A1 | | 11/2011 | Moss et al. | |
| 2014/0208917 | A1 | | 7/2014 | Whitney | |

FOREIGN PATENT DOCUMENTS

| | | |
|---|---|---|
| EP | 1570961 | 9/2005 |
| EP | 1759819 | 3/2007 |
| FR | 752033 | 9/1933 |
| GB | 467356 | 6/1937 |
| GB | 2312613 | 11/1997 |
| JP | 2003266373 | 9/2003 |

OTHER PUBLICATIONS

Nemco, Operating and Maintenance Instruction for Lettuce Kutter, 2012.
Nemco, Easy Cartride Onion Slicer, 2008.
Prince Castle LLC, Dice Witch, 2009.
Prince Castle LLC, Lettuce Kutlett, 2009.
Prince Castle LLC, Tomato Saber Operating Instructions, 1999.
Vollrath, Onion King Operator's Manual, 2014.

* cited by examiner

SLICER WITH BLADE SUPPORTS

CROSS REFERENCE TO RELATED APPLICATION

The present application is a continuation-in-part of U.S. patent application Ser. No. 15/267,730, filed Sep. 16, 2016 which application claims priority to U.S. Provisional Patent Application No. 62/221,363, filed on Sep. 21, 2015. The present application is also a continuation-in-part of U.S. patent application Ser. No. 14/833,744, filed Aug. 24, 2015 which application claims priority to U.S. Provisional Patent Application No. 62/043,918, filed on Aug. 29, 2014 and U.S. Provisional Patent Application No. 62/117,222, filed on Feb. 17, 2015. The contents of each application are hereby incorporated herein by reference in their entireties.

FIELD OF THE DISCLOSURE

The present disclosure is related to the field of slicing. More specifically, the present application is related to a produce slicer and blade supports and reinforcement members therefor.

BACKGROUND

Restaurant and food preparation industries require a large volume of produce to be processed such as by slicing so that the sliced produce can be used in food preparation and assembly. In addition to rapid slicing of produce, food preparation requires consistently sliced produce such that the food prepared with that produce is consistent in appearance, taste, texture, portion size, and cooking qualities between servings prepared.

Produce slicing is typically a manually performed task due to the aforementioned desire for consistency. As slicing necessarily requires some form of blade or cutting surface, this naturally involves a desire to seek solutions to improve safety for food preparation workers and maintain optimal operating conditions. Currently available slicing solutions have exposed blade sets that are elongated between opposite frame ends. As such, the exposed blade sets can present a risk to users during set up. Also, the elongated blades suffer from deflection during slicing. This can cause inconsistent slicing and/or damage to the blades.

BRIEF DISCLOSURE

An exemplary blade assembly for use with a produce slicer includes a first blade set having a first pair of opposing frame bars and a plurality of blades extending between the first pair of opposing frame bars and a blade cover positioned relative to the first blade set. The blade cover includes a first target ring that defines a first target area on the plurality of blades of the first blade set through which a piece of produce passes during slicing. A blade support extending through at least a portion of the blade set from the first target ring to support the plurality of blades.

An exemplary slicer includes a frame comprising a blade assembly receiving area and a head receiver and a blade assembly removably received within the blade assembly receiving area. The blade assembly has a first blade set comprising a first frame bar and a second frame bar and a plurality of blades extending therebetween, a blade cover positioned relative to the first blade set and including a planar top portion having a first target ring that defines a first target area configured to receive a piece of product to be sliced, and a blade support extending from the first target ring to support the plurality of blades. A pusher head is removably received within the head receiver, the pusher head comprising a pusher head body and a first produce pusher with a plurality of fins extending in a direction away from the pusher head body such that the first produce pusher aligned with the first target ring.

DETAILED DISCLOSURE

Figure 1:
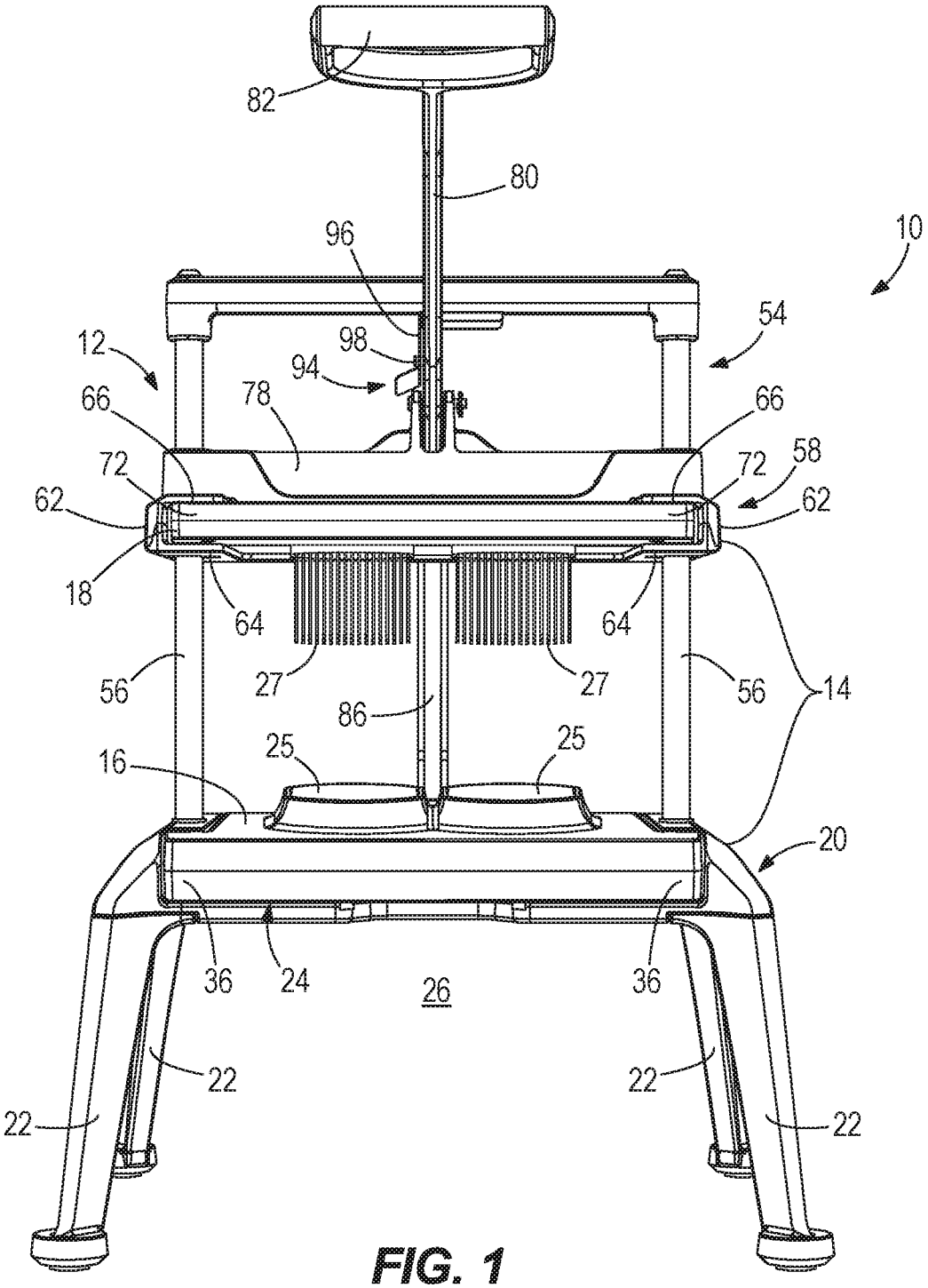
FIG. 1 is a front view of an exemplary embodiment of a slicing system.

FIGS. 1-5 depict a first exemplary embodiment of a produce slicer 10. The produce slicer 10 includes a frame 12. A blade cartridge 14 is received within the frame 12. The blade cartridge 14 includes a blade assembly 16 and a pusher head 18. In an exemplary and non-limiting embodiment, the blade assembly 16 and the pusher head 18 of the blade cartridge 14 are slidingly received into the frame 12. The frame 12 facilitates movement of the pusher head 18 relative to the blade assembly 16 such that the pusher head 18 is partially received within the blade assembly 16. The frame 12 will be described in further detail herein, with respect to the perspective view of the frame 12 depicted in FIG. 2 and the produce slicer 10 depicted in FIG. 1. The produce slicer 10 as well as other embodiments as described herein may exemplarily be used to cut any of a variety of produce, including, but not limited to: fruits, vegetables, meats, seafood, tofu, cheese and other foods. While embodiments are exemplarily described in further detail herein with specific reference to tomatoes, onions, and lettuce, it will be recognized that the range of available foods to be cut are not so limited.

The frame 12 includes a frame base 20 which itself may include at least one leg 22. In an exemplary embodiment, the frame base 20 includes four legs 22, each extending from a corner of the frame base 20. In a still further exemplary embodiment, a width dimension W between adjacent legs 22 and a depth dimension D between adjacent legs 22 are both at least 13 inches apart such that standard size food preparation containers may be inserted below the frame 12 from any of the front, rear, right, and left sides. This facilitates flexibility in placement of the produce slicer 10 within the food preparation area of a kitchen as well as to promote flexibility in work flows within the produce preparation area by food preparation workers. In a still further embodiment, one or more lower support bars (not depicted) extend between adjacent legs 22. In use, these lower support bars help to stabilize the slicer 10 in the event that one of the legs inadvertently slides off of the work surface.

The frame base 20 further includes a support surface 24. The support surface 24 as described in further detail herein supports the blade assembly 16. The frame base 20 therefore defines a product receiving area 26 between the legs 22 and below the support surface 24 wherein the aforementioned, but not depicted, produce receiving container may be positioned below the support surface 24 to receive the sliced produce after operation of the produce slicer 10. In an exemplary embodiment, the support surface 24 includes a front support 28, opposed lateral supports 30, and a rear support 32. In the exemplary embodiment depicted in FIG. 2, the support surface 24 includes all of the front supports 28, lateral supports 30, and rear supports 32 and such supports form a continuous support surface 24 around and above the product receiving area 26. It will be recognized that in alternative embodiments, the front support 28, lateral supports 30, or rear support 32 may be separate components of the frame base 20, or that the support surface 24 may be implemented with more or fewer support areas as disclosed. In still further embodiments, the frame base may include other numbers of legs, including three-legged versions. In another embodiment, the frame base and or support surface may be a cantilevered construction, for example with base plate (not depicted) forming the product receiving area and the support surface cantilevered over the base plate. Such a construction facilitates open access to the product receiving area exemplarily from the front and sides. In a still further embodiment, the frame base may be constructed with no or limited legs and configured to be secured to or positioned over the produce receiving container.

The front support 28 further includes support cut-outs 38 which are configured to receive arms 36 of the blade assembly 16, as will be described in further detail herein. The frame base 20 includes one or more target areas 25, as will be described in further detail herein. Additionally, embodiments of the front support 28 may include a finger cut-out 38 which facilitates insertion and removal of the blade assembly 16 with the frame 12. The finger cut-out 38 may exemplarily extend in a height dimension as exemplarily depicted in FIG. 2 or in another embodiment in depth dimension.

In further exemplary embodiments, the rear support 32 includes one or more support structures 40, which define at least one elevated support surface 42.

As will be described in further detail herein, the frame base 20 is configured to receive, hold, and support the blade assembly 16. The frame base 20 further includes lateral walls 44 and a rear wall 46 that may extend vertically from the support surface 24. The lateral walls 44 and the rear walls 46, together with the support surface 24 and cut-outs 38, define a blade assembly receiving area 48. In an exemplary embodiment, front alignment structures 50 are located in the cut-outs 38 of the lateral walls 44. Rear alignment structures 52 are exemplarily located on outward faces 49 of the rear wall 46. In embodiments as will be described in further detail herein, the front alignment structures 50 and rear alignment structures 52 matingly engage alignment structures located on the blade assembly 16 as will be described in further detail herein in order to align and secure the blade assembly 16 in the blade assembly receiving area 48. In an exemplary embodiment, the front alignment structures 50 are bodies (e.g. pins) that project from the outward faces 49 of respective lateral walls 44, and the rear alignment structures 52 are bodies (e.g. pins) that project from the rear wall 46. The front alignment structures 50 and the rear alignment structures 52 are matingly received by corresponding alignment holes located in the blade assembly 16 and described in further detail herein. It will be recognized by a person of ordinary skill in the art that a variety of other alignment structures may be used, including, the reverse of the embodiment depicted (e.g. alignment holes in the outward faces 49 of lateral walls 44 and rear wall 46) or other geometric shapes of mating structures.

The frame 12 further includes a pusher assembly 54 at least partially movably secured to the frame base 20. The pusher assembly 54 includes rails 56 which extend from the frame base 20. The pusher assembly 54 further includes a head receiver 58. The head receiver 58 is exemplarily slidingly secured to the rails 56 and is configured as described in further detail herein to receive a pusher head 18 of a blade cartridge 14. The head receiver 58 includes laterally opposed guide arms 60 and a rear guide 62. The guide arms 60 and rear guide 62 include lower plates 64 and upper plates 66. The lower plates 64 and upper plates 66 of the guide arms 60 and rear guide 62 define a pusher head receiving area 68 configured to receive a pusher head 18, and is exemplarily configured to slidingly receive a pusher head 18. The pusher head 18 is configured with one or more pushers 27 that correspond to a target area 25 of the blade assembly 16.

The guide arms 60 further include cut-outs 70 that are configured to receive respective arms 72 of the pusher head 18. The head receiver 58 further includes front alignment structures 74 located on the guide arms 60, and particularly exemplarily in the cut-outs 70 of the guide arms 60, as well as rear alignment structures 52 located in the rear guide 62 exemplarily between the lower plates 64 and the upper plates 66 of the rear guide 62. The front alignment structures 74 and rear alignment structures 76 are configured to matingly engage corresponding alignment structures as disclosed in further detail herein located on the pusher head 18 in order to facilitate alignment and engagement between the pusher head 18 and the head receiver 58. It will be recognized that the alignment structures 74 and 76 of the head receiver 58 are corresponding alignment structures of the pusher head 18 may exemplarily be the same as or in accordance with the disclosure above regarding the alignment structures 50 and 52 of the frame base 20 and alignment structures of the blade assembly 16.

The head receiver 58 further includes a force bar 78 that extends between the laterally opposed guide arms 60. The force bar 78 operates to translate force from an arm 80 connected to a handle 82 which movably engages the force bar 78. In an exemplary embodiment, the arm 80 has an inverted "L" shape to generally orient the handle 82 in a horizontal orientation, while it will be recognized that other orientations may be used including a more vertical arm 80, resulting in a vertically-oriented handle 82. In the exemplary embodiment depicted in FIGS. 1 and 2, the arm 80 is pivotably secured to the force bar 78 at an arm pivot 84. The arm pivot 84 translates generally downward force applied to the handle 82 by a user to the force bar 78 to direct the head receiver 58 downward towards the frame base 20 during operation of the produce slicer 10. In an exemplary embodiment, the arm 80 is further secured to a body 86 by a body pivot 88 and the body 86 is secured to the frame base 20 at a base pivot 90. The pivoted connection of the body 86 between the frame base 20 at the base pivot 90 and the arm 80 at the body pivot 88 reduces the overall operable footprint of the device such that the arm 80, body 86, or body pivot 88 do not extend laterally past the rear leg 22 of the base 20. In exemplary embodiments, this enables the produce slicer 10 to be positioned with the rear legs 22 engaging a wall or kitchen station divider enabling efficient use of workstation counter space. Embodiments of the combination of arm 80, arm pivot 84, body 86, body pivot 88, and base pivot 90 further limit the extent to which the handle 82 extends beyond the lateral dimension of the front legs 22 during operation of the produce slicer 10 and such that embodiments of the produce slicer 10 may be operated by a food preparation worker with minimized impact to the movement of other workers past the worker operating the produce slicer.

Embodiments of the frame 12 further include a rail crossbar 92 which extends between the laterally opposed rails 56. At least a portion of a latch 94 extends from the rail crossbar 92. The latch 94 may include a detent portion 96 which extends from the rail crossbar 92 and an engagement portion 98, which extends from the arm 80. However, it will be recognized by a person of ordinary skill in the art that the latch 94 as disclosed herein may be carried out through alternative implementations. These alternatives may include a reversal of the detent and engagement portions, or other releaseably engageable configurations of corresponding structures. In the embodiment depicted, the detent portion 96 comprises a metal plate which includes a receiving portion or at least one cut-out that receives the engagement portion 98. The plate of the detent portion 96 is configured to be deformable away from the arm 80 and engagement portion 98, such that the engagement portion 98 moves past a front end of the detent portion 96 before engaging in the cut-out portion. In operation, this creates a passively automated latch that is biased to secure the head receiver 58 in the open or "up" position. In a still further embodiment, this operates as a safety mechanism as it creates a two-handed operation of the produce slicer, such that the food preparation worker must place one hand on the rail crossbar 92 in order to release the latching mechanism 94, exemplarily with the worker's thumb, while the worker operates the handle 82 with the worker's other hand to slice the produce. This creates a mechanical safety feature whereby the worker removes both hands from the cutting area before operating the produce slicer, promoting worker safety.

The produce slicer 10 exemplarily includes at least one lock 63 configured to secure the blade assembly 16 to the frame 12. The produce slicer 10 further includes at least one lock 63 configured to secure the pusher head 18 to the frame 12. The produce slicer 10 exemplarily includes a blade assembly 16 with a handle 35 and a pusher head 18 with a handle 75. Reference is made to the above incorporated U.S. Provisional patent applications and U.S. patent applications for further description and operation of the locks 63 and handles 35, 75.

Figure 2:
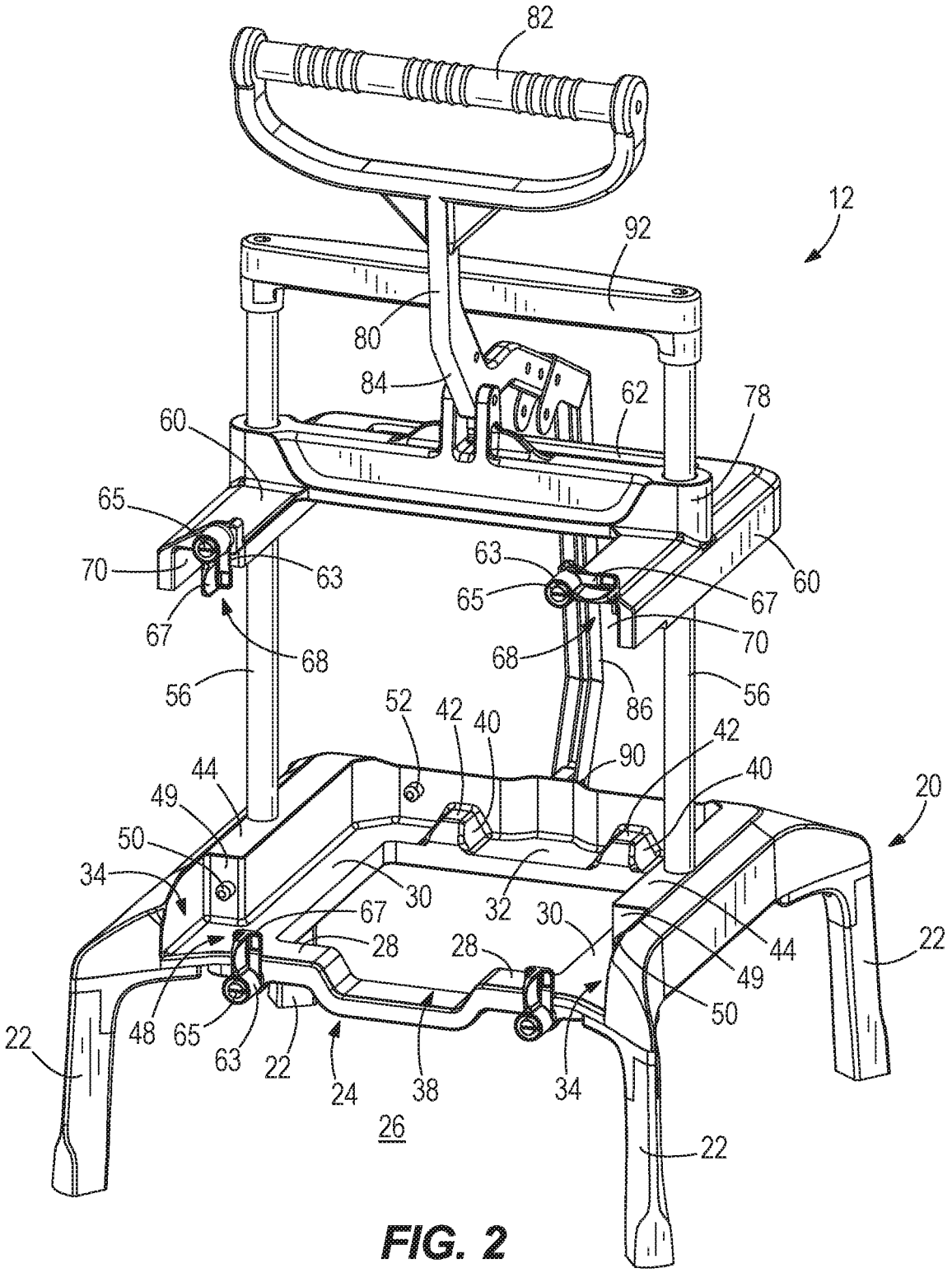
FIG. 2 is a perspective view of an exemplary embodiment of a frame for a slicing system.
Figure 3:
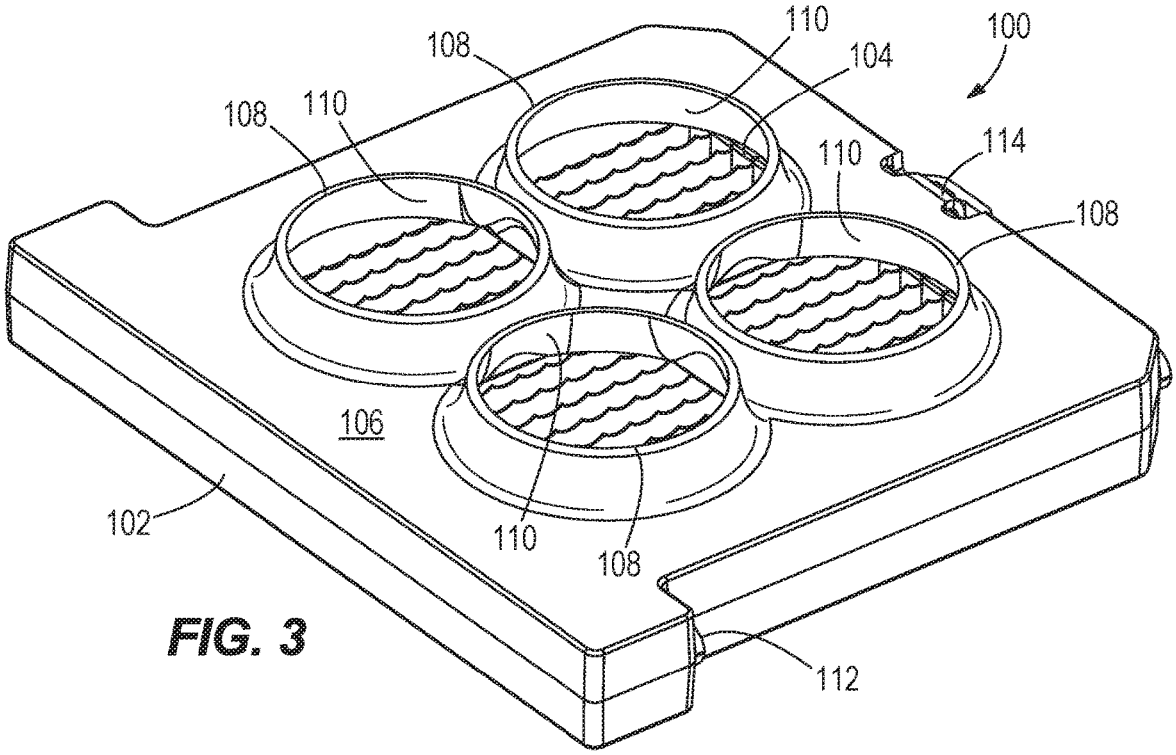
FIG. 3 is a perspective top view of a first embodiment of a blade assembly.

As best seen in FIG. 2, in exemplary embodiments, the frame 12 may be configured without lower plates 64 (FIG. 1). In such an embodiment, the elimination of the lower plates facilitates access for placing and removing the pusher head 18. [FIG. 3] In such embodiments, the placing/removing motion becomes more similar to that of the blade assembly 16 whereby both pusher head 18 and the blade assembly may be placed or removed with an angled motion. In another embodiment, the blade assembly 16 and the pusher head 18 nestingly engage each other, exemplarily by receiving the pushers(s) of the pusher head within the target ring(s) of the blade assembly. White the target rings 108 in FIG. 3 are depicted as circular, it will be recognized by other embodiments disclosed herein, as well as other embodiments disclosed in U.S. application Ser. No. 14/833,744 that the target rings may take any of a variety of other shapes.

FIG. 3 depicts an exemplary embodiment of a blade assembly 100 which may be used in conjunction with a frame 12 in a produce slicer 10. The blade assembly 100 includes a blade cover 102 and at least one blade set 104, both of which will be described in further detail herein. The blade assembly 100 is exemplarily configured to slice soft produce quickly. The embodiment of the blade assembly 100 depicted in FIG. 3 is exemplarily configured to slice four tomatoes or cucumbers. Various embodiments of blade assemblies 100 may be configured to receive different types of produce within the produce slicer 10. As will be described in further detail, the blade cover 102 includes multiple features that facilitate operation of embodiments of the produce slicer. The blade cover 102 includes a top portion 106 which is generally flat and extends across at least a portion of the at least one blade set 104 contained within the blade cover 102. The top portion 106 includes at least one target ring 108. In an embodiment, at least one of the target rings 108 extends upward from the top portion 106. In embodiments, the target rings 108 define a target area relative to the blades within which the produce is placed. The target rings therefore may define the target area without extending upward from the blade cover 102. In the exemplary embodiment depicted in FIG. 3, four target rings 108 extend from the top portion 106 to facilitate slicing of four tomatoes (or other produce) during a single actuation of the produce slicer 10.

The target rings 108 serve multiple functions. First, the target rings 108 generally define the shape of the produce to be sliced by the blade assembly 100. This limits the exposed portions of the blade set 104 to only the area of the blades needed to slice the produce. Additionally, the target ring 108 may extend vertically upward from the top portion 106 such as to further define a retaining lip 110 that holds the produce in place in the blade assembly 100. This retaining lip 110 helps to maintain alignment of the produce with the underlying at least one blade set 104. In addition to speed of slicing the produce, accuracy in slicing produce is also desirable as food preparation and restaurant standards often require that the produce be sliced in a particular orientation relative to the physical structure of the produce itself. Therefore, it is desirable for the produce to be sliced to be held in a position relative to the blade set between placement and slicing of the produce with the produce slicer 10. In still further embodiments, the target ring 108 may further facilitate this orientation of the produce relative to the at least one blade set by corresponding the shape of the target ring 108 to any generalized features of the shape of the produce to be sliced when placed in the desired orientation.

In a still further function, the target rings 108, and the retaining lip 110 further protect fingers of workers when inserting food into the target ring 108 by creating a still further barrier between fingers and the blades within the blade cover. In use, the worker must release the food before the retaining lip 110.

The blade cover 102 further includes alignment structures 112 which are configured to matingly engage the exemplary front and/or rear alignment structures found on the frame base and the pusher assembly. Embodiments of the blade cover 102 further include a resilient finger 114 which can facilitate connection and removal of the at least one blade set 104 to the blade cover 102.

Figure 4:
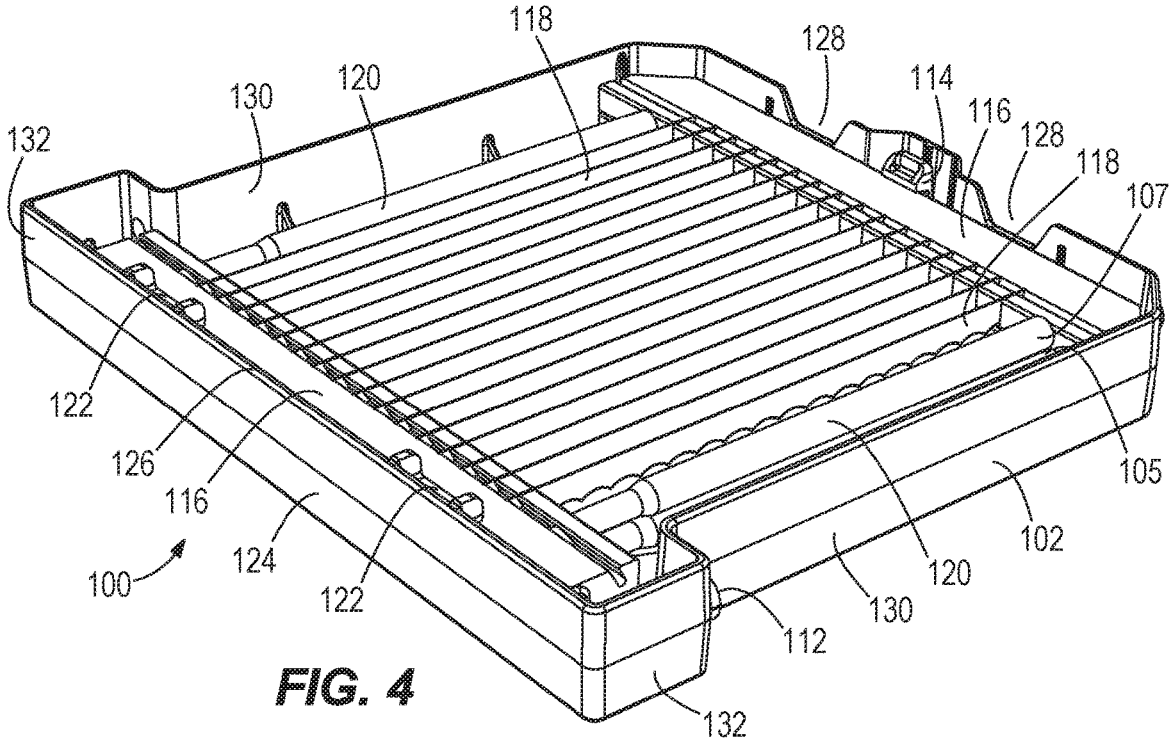
FIG. 4 is a perspective bottom view of the first embodiment of the blade assembly.

FIG. 4 is a bottom perspective view of an exemplary embodiment of the blade assembly 100 as depicted in FIG. 3. From the bottom view of the blade assembly 100 depicted in FIG. 4, two blade sets 104 can be seen stacked upon one another within the blade cover 102. In other embodiments of the blade assembly, other numbers of blade sets 104, including but not limited to one blade set or three blade sets, may be used. In an exemplary embodiment, the blade set 104 includes two opposed frame bars 116 across which a plurality of blades 118 are secured. In exemplary embodiments. In embodiments, the frame bars may be constructed as extrusions, cast, machined, or milled. It will be recognized that other manufacturing techniques may be used while remaining within the scope of the present disclosure. While the blade set 104 is depicted with two frame bars 116, it is understood that more or fewer frame bars may be used in embodiments. In an embodiment the two or more frame bars may be portions of a continuous structure such as a frame. In embodiments such a frame may be milled from a single piece of material or cast as a unitary structure. In a still further embodiment, the frame bars may be portions of a ring, oval, rectangular, square, or other shaped frame within which the blades are secured. In still further embodiments as described herein, the frame bars may be constructed of multiple pieces secured together and secured to the blades.

The blades 118 are may be serrated in order to reduce the surface area of the blades that engage the produce at any one time, exemplarily such as to be able to cut through the tough skin of a tomato as compared to a head of lettuce, or the meat of the tomato. It will be recognized that other types of blades may be used as well. One or more tensioning rods 120 extend between the opposed frame bars 116. Embodiments of the tensioning rods 120 may include a tensioning screw (not depicted), which is operated in order to achieve a desired tension on the plurality of blades 118. It will be noted that when multiple blade sets 104 are used together with a blade assembly 100, that the blades 118 of the respective blade sets 104 are offset from one another. It will be recognized that the distance between adjacent offset blades corresponds to a desired thickness of the sliced produce. Offsetting of the blades further reduces the surface area engaged by the skin or surface of the produce at one time which promotes produce slicing. Still further embodiments may use a variety of other blade sets and include a blade cover 102 configured in the manners as disclosed herein to receive those other blade sets. Non-limiting exemplary embodiments of other blade sets which may be used include the 908, 910, 912, 925, and 943 series of blade sets all currently available from Prince Castle, LLC.

As previously disclosed, in an embodiment, two blade sets 104 are secured within the blade cover 102. In an embodiment, the blade sets 104 are secured within the open interior of the blade cover 102 defined by the top portion 106 and the sides 130. The two blade sets 104 are exemplarily a top blade set 105 and a bottom blade set 107. In an embodiment, one or more support ledges 122 extend from the interior of the front side 124 of the blade cover 102. The front side 124 terminates in a front lip 126. The support ledges 122 engage a bottom blade set 107 of the at least one blade set at the front end of the blade cover 102 and the aforementioned finger 114 extending from the rear end of the blade cover 102 engages the bottom blade set 107 at the rear end of the blade assembly 100. Therefore, the combination of the support ledges 122 and the finger 114 hold the at least one blade set 104 within the blade cover 102 to form the blade assembly 100. In an embodiment as depicted that uses two or more blade sets, the support ledges 122 and finger 114 are located such that engagement between the support ledges 122, finger 114, and bottom blade set 107, also retains the top blade set 105 within the blade cover 102.

In other embodiments, the blade sets may be secured within the blade cover in a variety of other ways. One or more cross-pins may extend along the bottom of the blade cover below the blade sets to retain the blade sets within the cover. Fasteners, including screws, pins, or rivets may extend through the sides of the blade cover into one or more of the blade sets, exemplarily into the frame bars. Fasteners may extend into one or more of the blade sets through the top surface of the blade cover. In one exemplary embodiment, the blade cover may include limited or no side walls and the planar top portion of the blade cover is secured to the blade sets. The blade cover may extend at least partially around the blade sets by including a bottom side opposite the top surface. In a modified embodiment, the blade cover may at least partially surround the blade sets on top, bottom, and sides, and the blade cover comprises at least two pieces that may be secured to one another to locate and retain the blade sets therein. In a still further embodiment, the blade cover may be independently fixable to the frame from one or more blade set.

In use, when the blade assembly 100 is inserted into the blade assembly receiving area 48 of the frame 12, the support ledges 122 engage the front support 28 such that the slicing force against the at least one blade set 104 is transferred through the support ledges 122 to the front support 28 of the support surface 24. The blade cover 102 further includes cut-outs 128 that are configured such that support structure 40 can pass through the wall of the blade cover 102 at the rear of the blade cover 102 and the elevated support surfaces 42 of the support structures 40 directly engage the bottom blade set 107. Thus, the blade set, which must resist the slicing force placed on the blade set through the produce and the pusher head are supported by the support surface of the frame 12.

Embodiments of the blade assembly 100 further facilitate worker safety as the blade cover defines spaces for the worker to grab and hold the blade assembly 100 when placing and removing the blade assembly from the produce slicer. For example, the worker can grip over the front lip 126 and the worker's fingers will touch either the frame bar 116 or the non-cutting side of the blades 118. The worker may also grip the blade assembly 100 from the blade cover sides 130 where the worker's fingers will engage a space between the sides 130 and the tension rods 120 therefore away from the blades 118. Still further, the worker may grip the arm 132 of the blade assembly, where the worker may either grip the arms 132 of the blade cover 102 or within a region interior to the arms 132 between the sides 130 and the frame bar 116. In each of these cases, the worker's fingers are naturally located at positions removed from the blade and the cutting surfaces of the blades 118 are interior to the blade assembly 100 and away from general access by the worker.

In other embodiments of the produce slicer 10, the blades 118 of the blade sets 104 are held in tension which enables the operation of the produce slicer 10 by pushing the pieces of produce through the blades 118 of the blade sets 104 by a force applied by the produce pushers of the pusher head. However, forces on the blades 118 during the cutting process may cause deflections or bending in the blades that over time reduce the tension in the blade set that worsens over time, reducing a useful life of the blade set. Additionally, this deflection can cause error in the dimensional width of the sliced produce from a nominal slick thickness. Therefore, in certain exemplary embodiments, the target rings 256 extend towards the blades 118 of the blade sets 104 below a level of the top portion 106 of the blade cover 102 into the open interior of the blade cover 102 to produce one or more blade supports 262 which will be described in further detail herein, with respect to FIG. 5.

Figure 5:
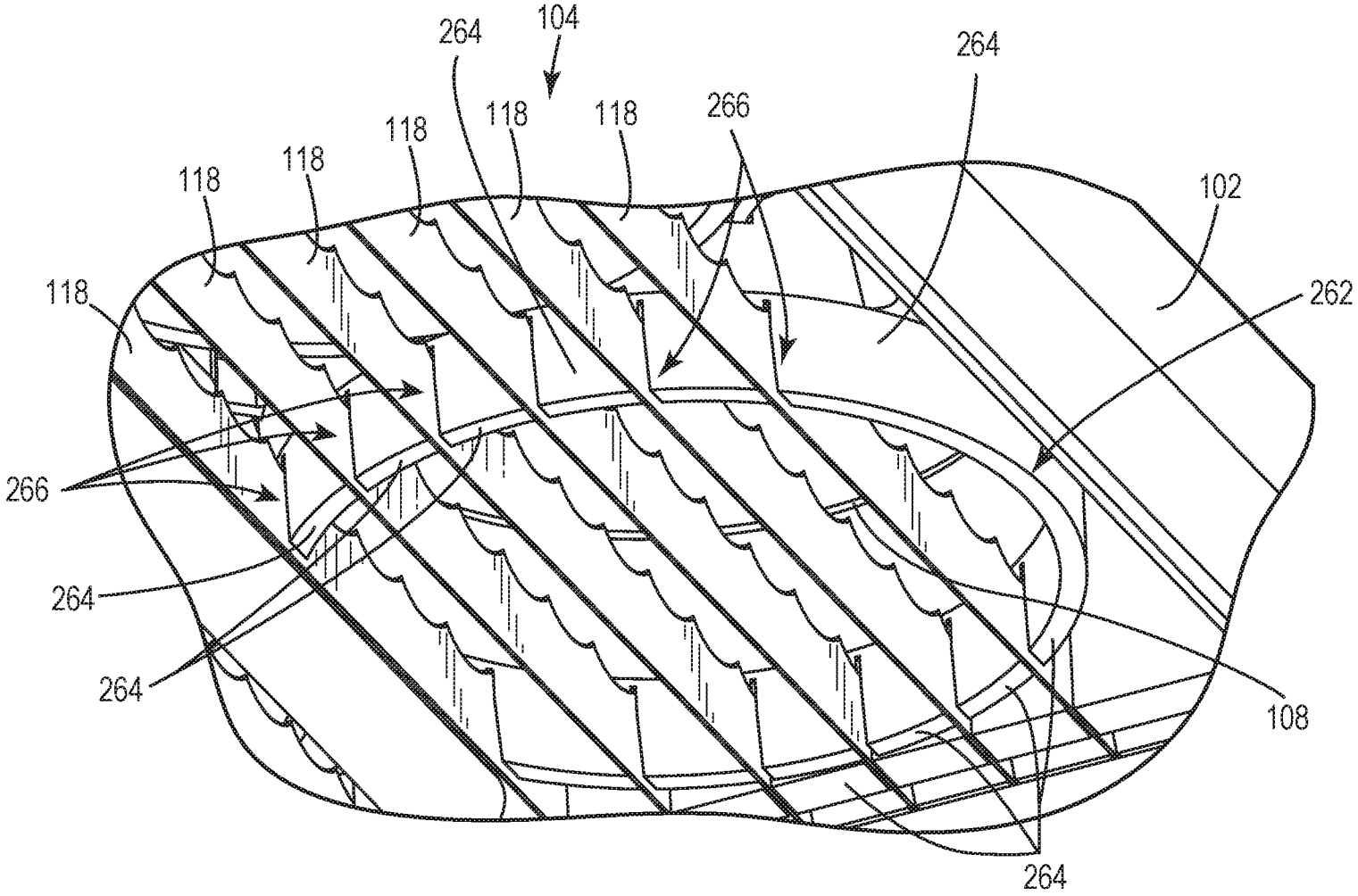
FIG. 5 is a bottom perspective view of an exemplary embodiment of a portion of a blade assembly.

FIG. 5 is a bottom perspective view of a portion of an exemplary embodiment of a blade set 104 and a blade cover 102 with a blade support 262. The blade support 262 is exemplarily constructed of a plurality of fingers 264 separated by blade slots 266. The blade support 262 includes a series of pairs of blade slots 266 each aligned to receive a single blade 118 of a blade set 104 there between. Exemplarily, the blade slots 266 may be configured to receive only blades of a top blade set of a pair of stacked blade sets in an exemplary blade assembly 100, as these blades are closest to the blade cover 246 and initiate cutting of the produce. In other embodiments, the blade support 262 includes blade slots for the blades of both a top blade set and a bottom blade set. It will be recognized that embodiments may include blade supports 262 associated with each of the plurality of target rings 108 in the blade cover 102. In such embodiments, blade slots 266 may be aligned between adjacent blade supports 262. In such an exemplary embodiment, each blade 118 of a blade set may therefore be supported by blade slots 266 of blade supports 262 at four locations across the length of the blade 118. The blade slots 266 are constructed within a sufficient manufacturing tolerance of the width of the respective blades so that the blades 118 held in the blade slots 266 are supported from bending or rotation during the cutting process. This is exemplarily depicted in FIG. 5 in which a plurality of blades 118 can be seen supported by a plurality of blade slots 266 of the blade support 262. As will be described in further detail herein, in still further embodiments, the blade supports 262 may be independent structures apart from the target rings 108. The blade supports 262 may be secured to the blade set 104, or extend to the blades 118 from another portion of the blade cover 102, for example the top portion 106 or one or more of the sides.

Figure 6:
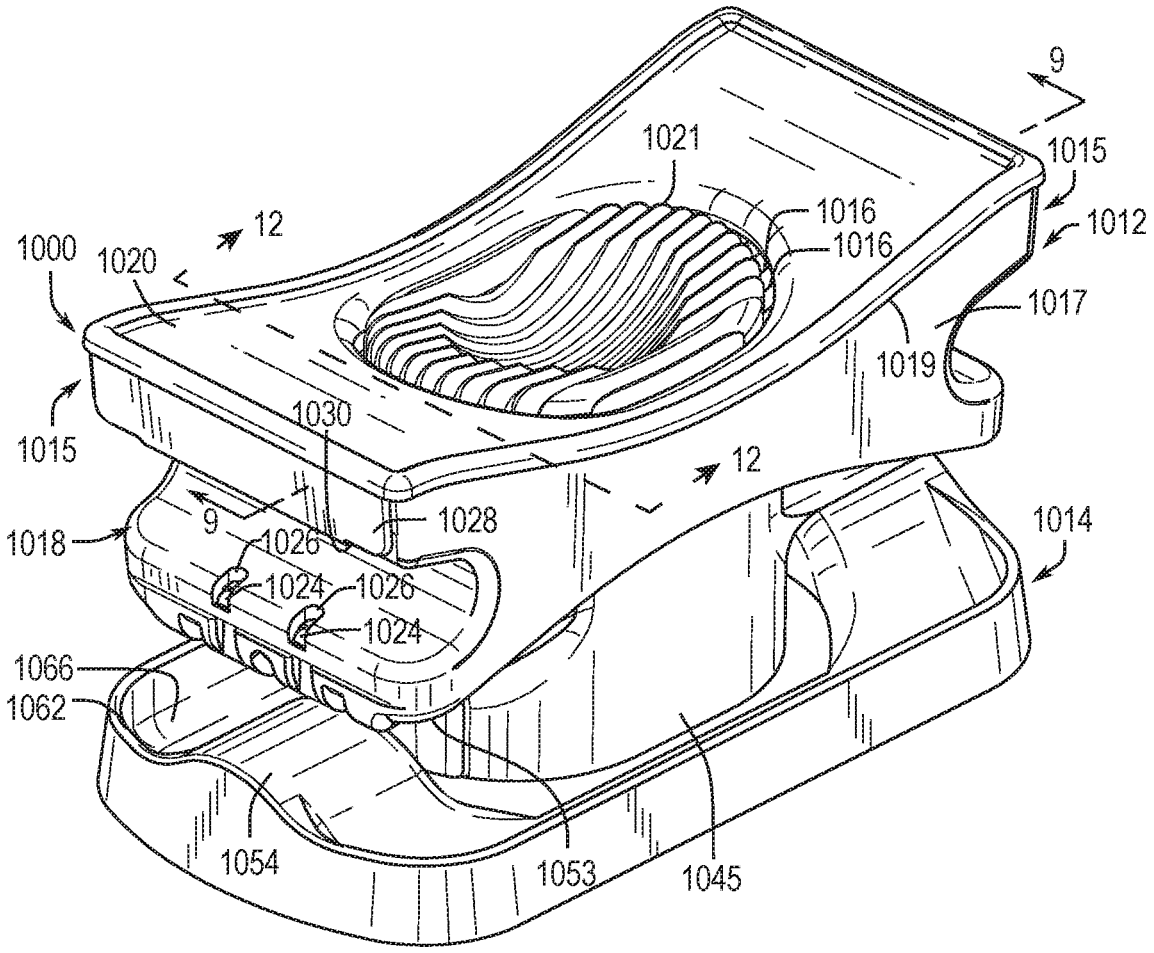
FIG. 6 is a perspective view of an exemplary embodiment of a slicer in a closed position.
Figure 7:
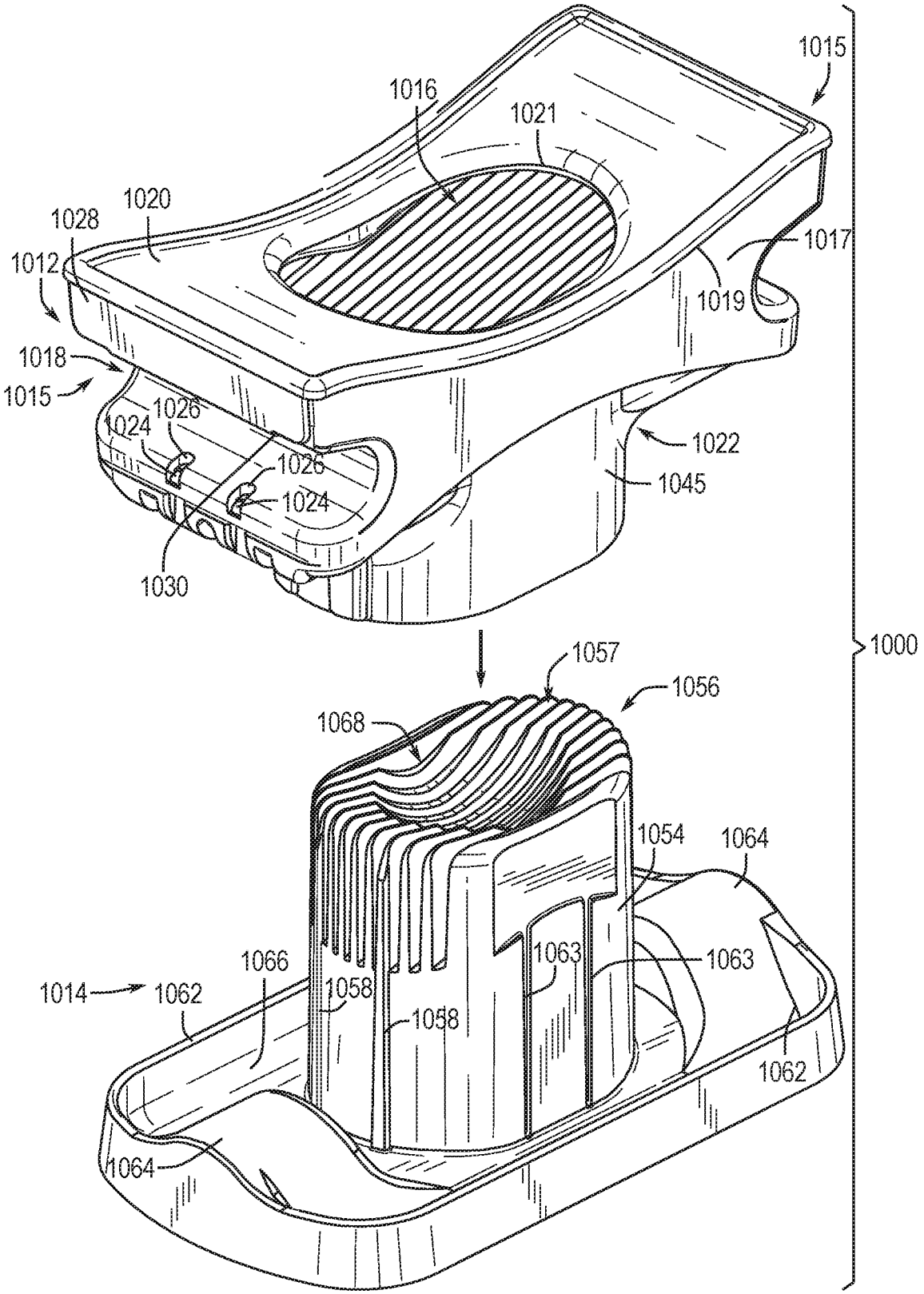
FIG. 7 is a perspective view of an exemplary embodiment of the slicer in an open position.

FIGS. 6 and 7 depict another exemplary embodiment of the produce slicer 1000. The slicer 1000 is depicted in a closed position in FIG. 6, while the slicer 1000 is depicted in an open position in FIG. 7. The slicer 1000 is exemplarily configured as a manually operable slicer for slicing a single piece of food at a time.

The slicer 1000 includes a head 1012 and a base 1014. The base 1014 supports the food (e.g. tomato) to be cut. The head 1012 includes the blades 1016 and handles 1015 and is brought down over the food to slice the food. In an exemplary embodiment, the head 1012 is constructed of three sections, a blade cover 1018, a lid 1020, and a target ring 1022. In one embodiment, each of the blade cover 1018, lid 1020, and target ring 1022 may be constructed as separate pieces. However, it will be recognized that in other embodiments, some or all of these sections may be wholly or partially integrally formed. In the embodiment depicted, the blade cover 1018 and target ring 1022 are connected together by tabs 1024 of the target ring 1022 which engage holes 1026 through the blade cover 1018. It will be recognized that other arrangements including, but not limited to reversing the tabs and holes may be used to connect the blade cover and the target ring.

The slicer 1000 exemplarily depicted in FIGS. 6 and 7 exemplarily differs from the slicer 10 depicted in FIGS. 1 and 2 in that generally, the movable and fixed components are exemplarily reversed. In the slicer 10, the blade assembly 16 remains stationary and that supports the food to be cut. The food is cut by moving the pusher head 18 which engages the food and pushes the food through the blades of the blade assembly 16. In the slicer 1000, the base 1014 supports the food to be cut and remains stationary while the head 1012 contains the blade set as described herein and is moved through the food supported by the base 1014. Thus, while operationally the head 1012 and base 1014 of the slicer 1000 reverse relative positions, the head 1012 of the slicer 1000 structurally corresponds to the blade assembly 16 and the base 1014 of the slicer 1000 structurally corresponds to the pusher head 18 of the slicer 10. Specifically referring to the head 1012, the blade cover 1018 bears structural similarities to that of the blade cover 102 and the target ring 1022 similarly bears structural similarities to the target ring 108 as described above.

The lid 1020 is removably connected to the blade cover 1018. The lid 1020 is generally concave in profile, being taller relative to the base 1014 at the handles 1015 and lower at the center near hole 1021 through which the blades 1016 are exposed. The top edge 1019 of the sidewalls 1017 of the blade cover 1018 are exemplarily concave in shape to correspond to and engagingly fit the lid 1020. The hole 1021 through the lid 1020 is exemplarily configured to match the shape of a portion of the base 1014 that protrudes therethrough as described in further detail herein. The lid 1020 is exemplarily removably connected to the blade cover 1018 with arms 1028 ending in fingers 1030 which engage lips 1031 exemplarily formed by undercut 1032 into the blade cover 1018 (see e.g. FIGS. 8 and 9). Flexibility in the arms 1028 and/or lid 1020 enables the arms 1028 and/or lid 1020 to deform or flex outwardly to secure the lid 1020 over the blade cover 1018 and exemplarily for the arms 1028 and fingers 1030 to engage the lip 1031 in the undercut 1032 of the blade cover 1018. Removal of the lid 1020 from engagement with the blade cover 1018 enables access to the open interior 1042 of the blade cover 1018 for placement or removal of the blade set 1034.

Figure 8:
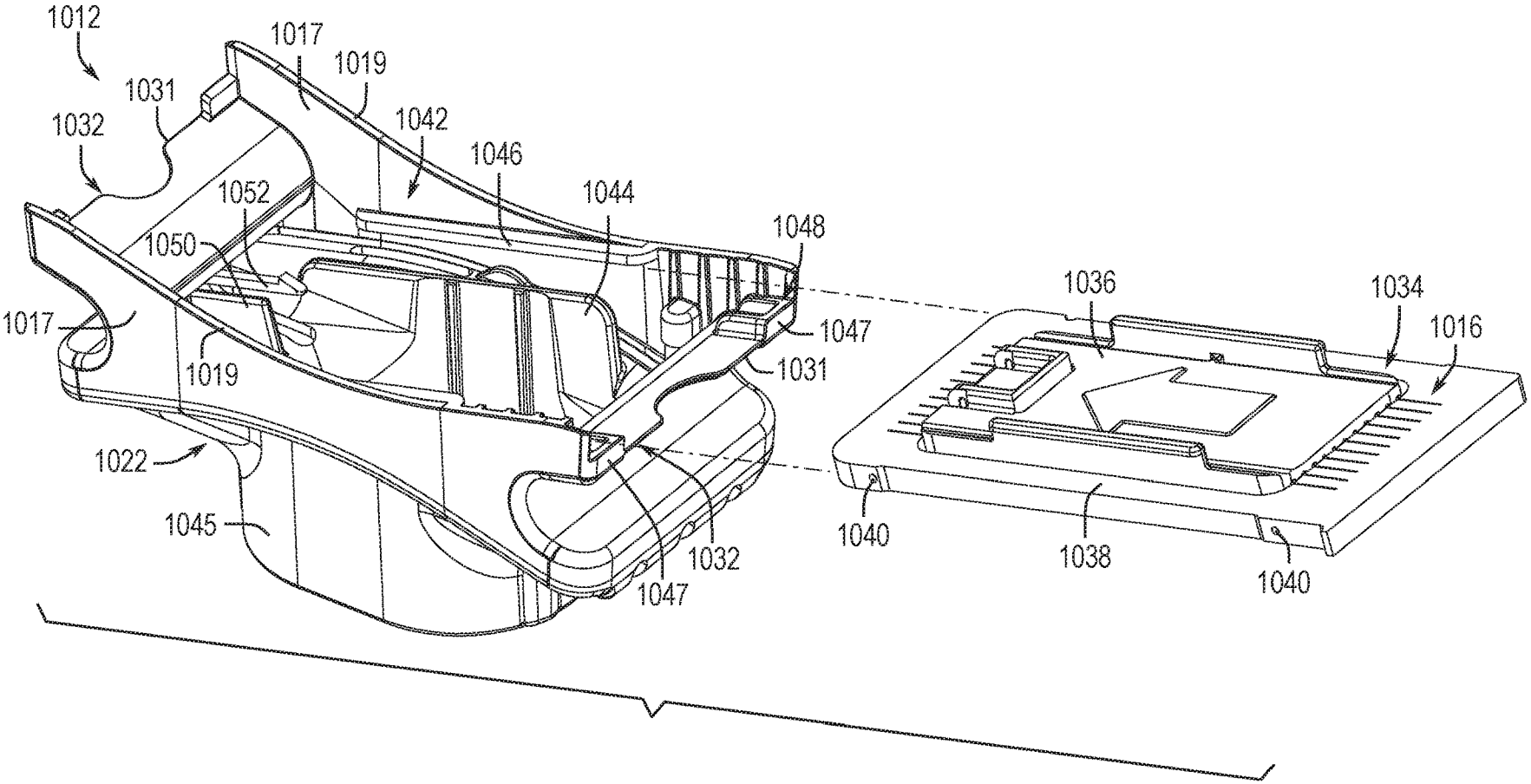
FIG. 8 is a perspective view of an exemplary embodiment of a slicer head during installation or removal of a blade set.
Figure 9:
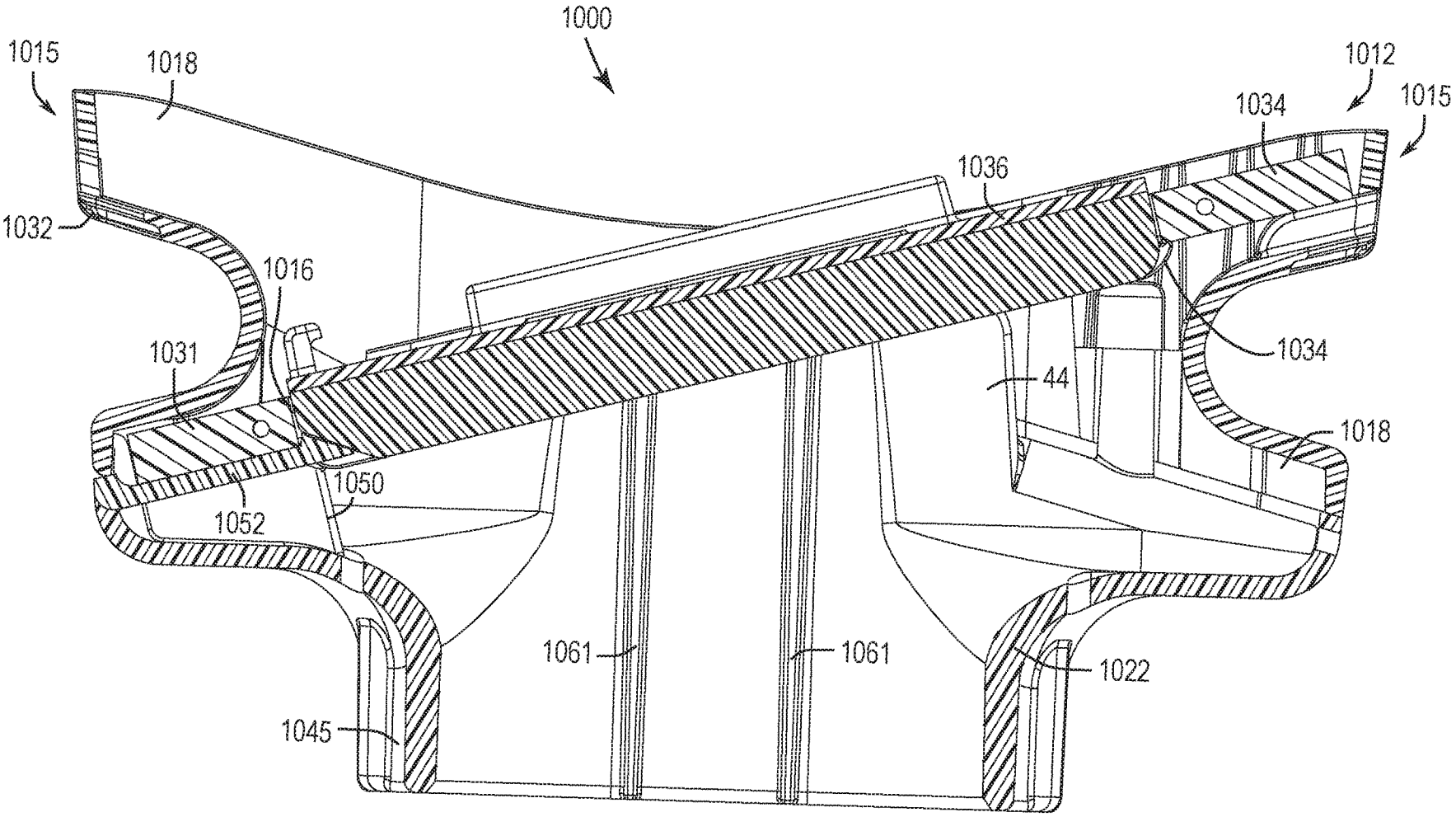
FIG. 9 is a sectional view taken along line 9-9 of FIG. 6, although depicting the lid removed and the safety comb installed on the blade set.

FIG. 8 depicts the head 1012 with the lid 1020 removed and blade set 1034 to which a safety comb 1036 is attached, outside of the head 1012. The safety comb 1036 is configured to protect a handler from exposure to the blades 1016 in the blade set 1034 and facilitate safe insertion and removal of the blade set 1034 from the head 1012 is secured to the blade set 1034. Embodiments of the safety comb 1036 are explained in further detail in pending U.S. application Ser. No. 15/267,730 which is incorporated herein by reference. The blade set 1034 is exemplarily constructed with a frame 1038 of a single piece of machined metal between which a plurality of blades 1016 extends. The frame 1038 is exemplarily placed under a compressive force, and the blades 1016 secured to the frame 1038 with a pins 1040 through the frame 1038 and the blades 1016 at either end of the blade set 1034. While the blade set 1034 is depicted and described in use herein, it will be understood that other forms and types of blade sets may be used with other embodiments of the slicer 1000. While the blades 1016 are depicted as flat, exemplary embodiments may include serrated blades. Non-limiting exemplary embodiments of other blade sets 1034 which may be used include the 908, 910, 912, 925, and 943 series of blade sets all currently available from Prince Castle LLC.

The head 1012 includes a generally open interior 1042. The blade set 1034 is secured within the open interior 1042 as described in further detail herein and the open interior 1042 is configured to receive a portion of the base 1014 as will also be described in further detail herein. The head 1012 includes support ridges 1044 which engage and support the blade set 1034 from below. The support ridges 1044 are exemplarily a portion of the target ring 1022 of the head 1012 and extend into the blade cover 1018 when the target ring 1022 and blade cover 1018 are connected. The head 1012 includes lips 1046 which engage and support the blade set 1034 from above. The lips 1046 are exemplarily a portion of the blade cover 1018 of the head 1012 and extend into the open interior 1042 of the head 1012 from the sidewalls 1017 of the blade cover 1018. When the blade cover 1018 is secured to the target ring 1022, a lip 1046 of the blade cover 1018 and a support ridge 1044 of the target ring 1022 are aligned to receive the blade set 1034 therebetween. The blade set 1034 is slid into and out of the head 1012 between the lips 1046 and the support ridges 1044. The head 1012 holds the blade set 1034 in the open interior 1042 at an angle. In exemplary embodiments, the blade set 1034 is held at an angle between 10-20 degrees. In other embodiments, the blade set 1034 is held at an angle greater than 20 degrees, while in another embodiment, the blade set 1034 is held at an angle of 15 degrees or about 15 degrees. The angle of the blades 1016 of the blade set 1034 relative to the food to be cut facilitates cutting by reducing the outer surface area of the food being sliced at one time. The outer surface area of the food being sliced often includes a tougher skin relative to the rest of the food.

As further seen in FIG. 8, the head 1012 includes two support posts 1048 at the end at which the blade set 1034 is inserted. These support posts 1048 further support the blade set frame 1038 at an end of the blade set 1034. The support posts 1048 further include exterior faces 1047 which may exemplarily engage the arms 1028 of the lid 1020 when the lid 1020 is secured to the blade cover 1018. The head 1012 includes a ledge 1050 and fingers 1052, which respectively engage the safety comb 1036 and the blade set 1034 during installation and removal of the blade set 1034 as disclosed in further detail herein. In the embodiment depicted, the ledges 1050 and the fingers 1052 are exemplarily a part of the target ring 1022 and extend into the blade cover 1018.

Figure 10:
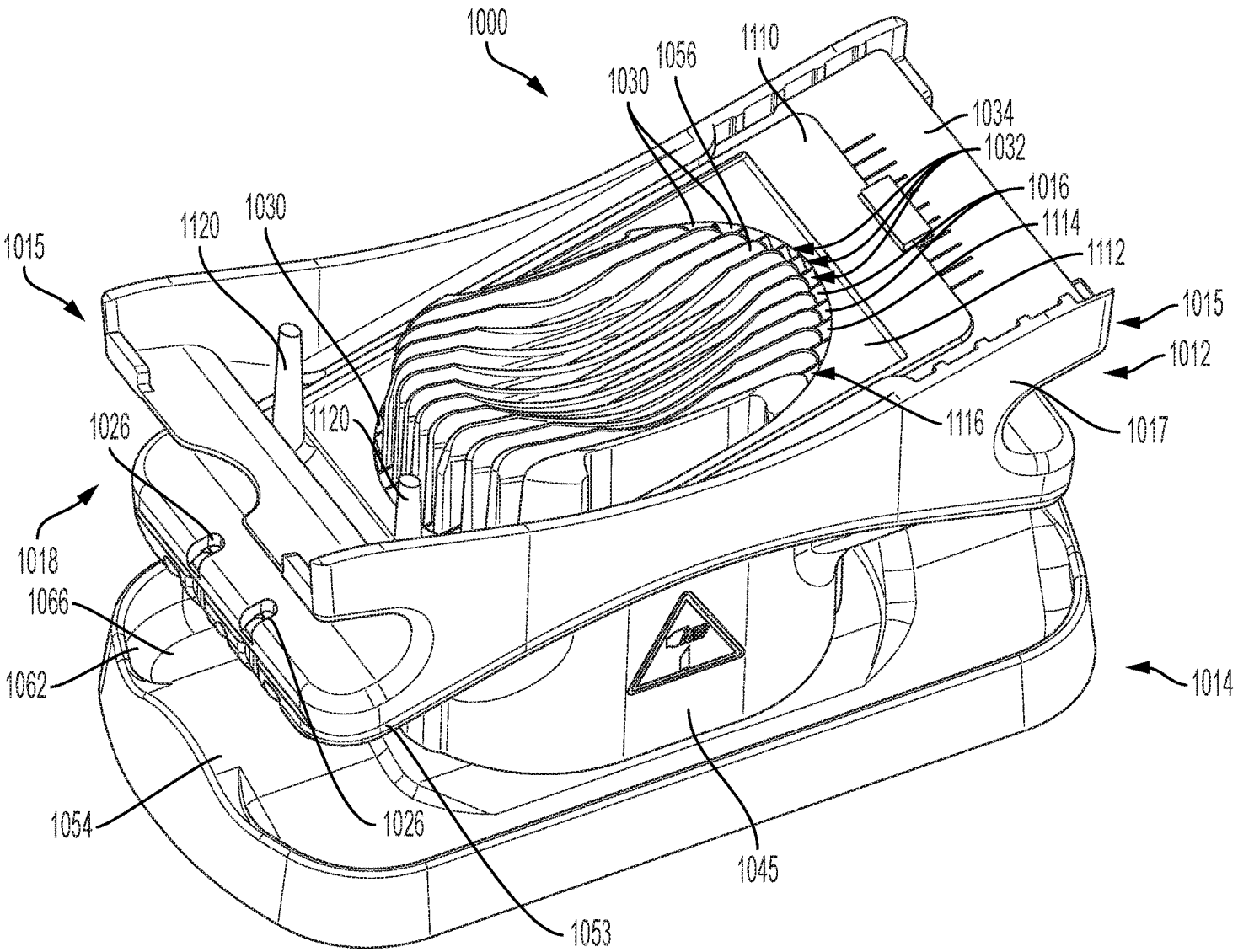
FIG. 10 is a perspective view of an alternative embodiment of the slicer with the lid removed to depict the blade set and an exemplary blade support.
Figure 11:
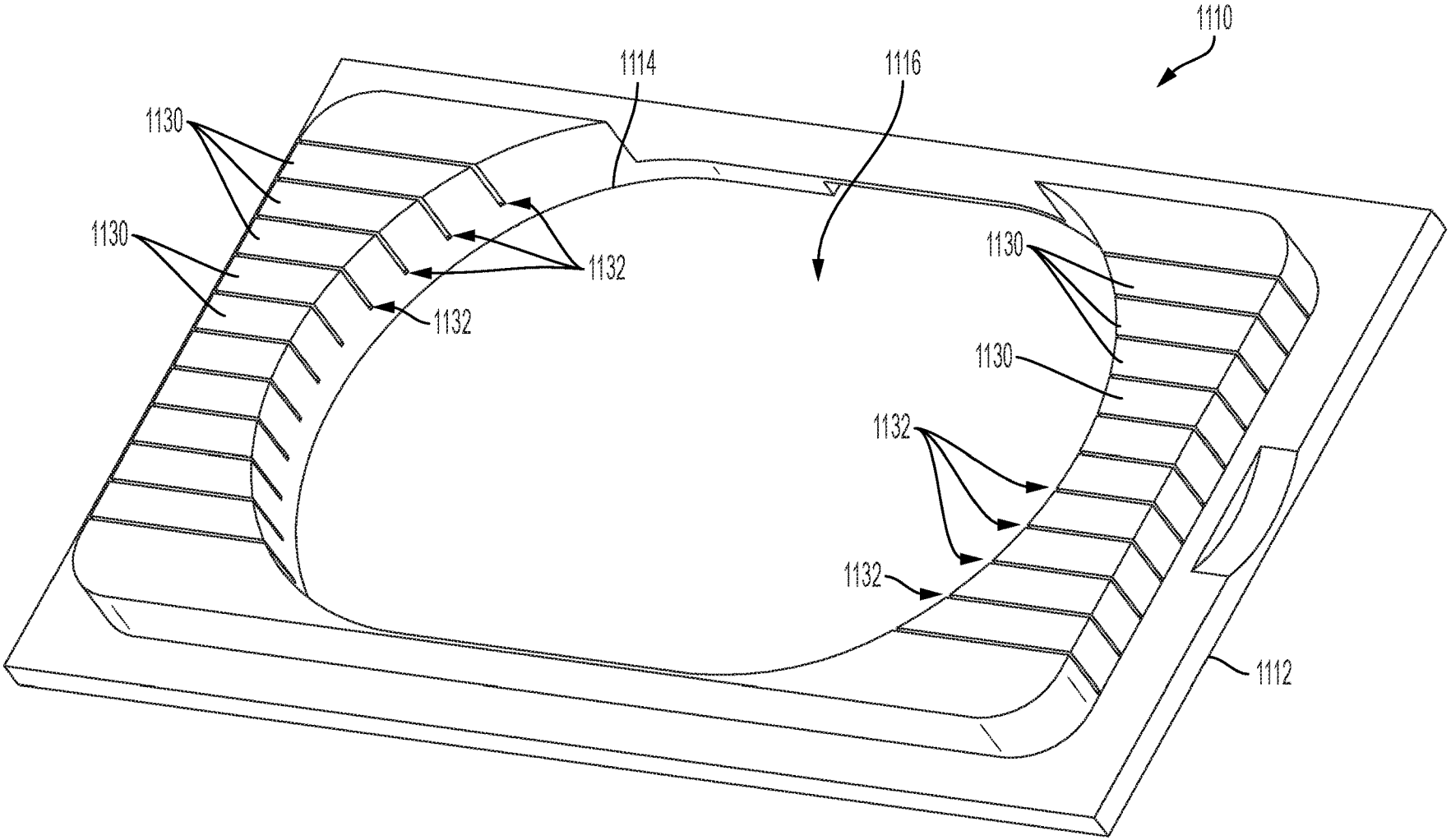
FIG. 11 is a perspective view of an exemplary embodiment of a blade support.
Figure 12:
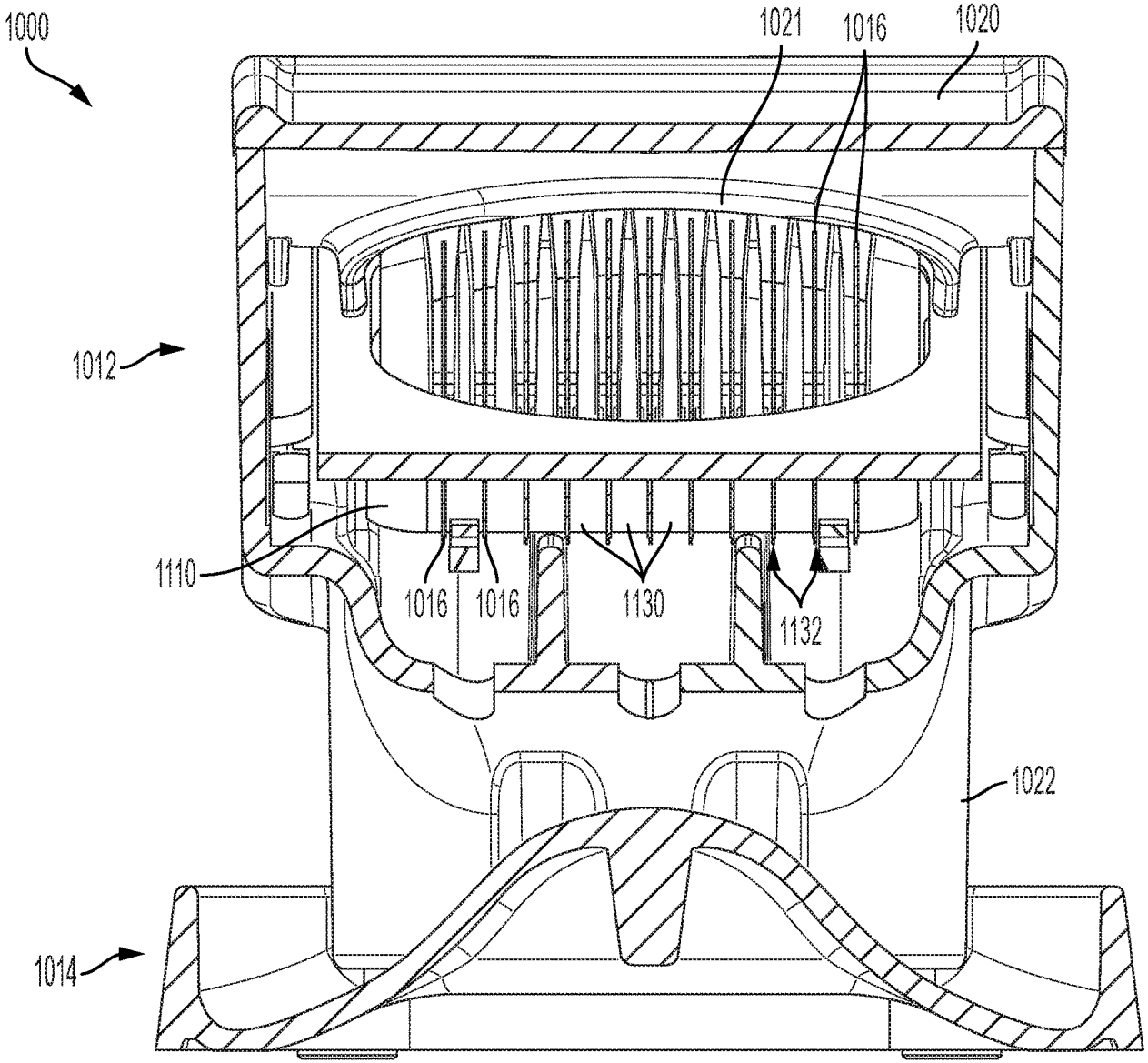
FIG. 12 is a sectional view taken along line 12-12 of FIG. 6, and including the embodiment of the blade support.

Referring to FIGS. 10-12, the blades 1016 of the blade set 1034 are held in tension which enables the operation of the produce slicer 1000 by pushing the blades 1016 of the blade set 1034 through a piece of produce positioned on the base 1014. A user exemplarily applies the slicing force to the handles 1082 to slice the produce. Forces on the blades 1016 during the cutting process may cause deflections or bending in the blades 1016 that results in errors in slice thickness, and cause the blades 1016 to collide with fins of the base 1014. Over time blade tension in the blade set 1034 loosens. This loss of tension worsens over time, reducing a useful life of the blade set 1034.

A blade support 1110 is exemplarily positioned within the blade cover 1018 and in engagement with the blade set 1034 and, more particularly, with the blades 1016 of the blade set 1034. In embodiments, the blade support 1110 is resiliently engaged with the blade set 1034. In certain embodiments this includes a friction fit engagement with the blades 1016 of the blade set 1034 in the slots 1132 of the blade support 1110. In another embodiment, the blade support 1110 may engage the frame 1038 with a friction fit or with a latching engagement. One exemplary embodiment of a latching engagement which may be used depicted and described with respect to the safety comb 1036 of FIG. 8. A person of ordinary skill in the art will recognize that these and other embodiments may be combined to form additional manners by which the blade support 1110 may be secured to the blade set 1034 while remaining within the scope of the present disclosure. The blade support 1110 may exemplarily operate in the manner as described above to support the blades 1016 from deflection during slicing. The blade support 1110 includes a planar top portion 1112 that exemplarily includes the target ring 1114 that defines the target area 1116 on the blades 1016. The target area 1116 is sufficient in area for the food to be sliced and the fins 1056 of the head 1012 to pass through. The blade support 1110 includes a plurality of fingers 1130 separated by blade slots 1132 which each receive a blade 1016 of the blade set 1034. The plurality of fingers 1130 exemplarily extend from the target ring 1114 to support the plurality of blades 1016 received with the respective blade slots 1132. An aligned pair of blade slots 1132 and associated fingers 1130 supports each blade 1016 in the blade set 1034 at two locations along each of the blades 1016.

In the embodiment depicted in FIG. 10, the blade support 1110 includes at least one support guide 1120 that extends away from the planar top portion 1112 in the direction of the lid 1020 whereby the lid 1020 acts on the support guides 1120 to thereby force the blade support 1110 into contact with the blade set 1034. The support guides 1120 may include an engagement support surface 1122 configured to facilitate contact with the lid 1020 particularly of the planar top portion 1112 and the lid may not be parallel to one another. The plurality of fingers 1130 extend away from the planar top portion 1112 in a direction opposite from the support guides 1120. The plurality of fingers 1130 are separated by a plurality of blade slots 1132 defined there between. It will be recognized that the support guides 1120 may be optional in embodiments, for example as shown in FIGS. 11 and 12.

As depicted in the exemplary embodiments of FIGS. 10-12, the blade support 1110 exemplarily engages the blade set 1034 on a side opposite the cutting surfaces of the blades 1016 of the blade set 1034 and the fingers 1130 project through the blade set 1034 along the blades 1016 in the direction of the cutting surface of the blades. It will be recognized that in an alternative embodiment, the blade support 1110 may extend over the cutting surfaces of the blades 1016 and extend through the blade set 1034 in a direction away from the cutting surfaces of the blades. In certain exemplary embodiments, pairs of the blade slots 1132 are aligned to receive a single blade 1016 of the blade set 1034 there between. In use, the plurality of blades 1013 are positioned in the plurality of blade slots 1132 such that the plurality of fingers 1130 extends between the plurality of blades 1016. The blade slots 1132 are constructed within a sufficient manufacturing tolerance of the width of the respective blades 1016 so that the blades 1016 held in the blade slots 1132 are supported against bending or rotation during the cutting process. In still further embodiments, the blade supports may be independent structures apart from the target ring 1114. The blade supports may be secured to the blade set 1034, or extend to the blades 1016 from another portion of the blade cover 1018, for example the top portion or one or more of the sides.

FIGS. 11 and 12 depict another exemplary embodiment of the blade support 1110. The blade support 1110 includes the planar top portion 1112 that exemplarily includes the target ring 1114 that defines the target area 1116 on the blades 1016. The blade support 1110 includes the plurality of fingers 1130 separated by blade slots 1132 which each receive a blade 1016 of the blade set 1034. The plurality of fingers 1130 exemplarily extend from the target ring 1114 to support the plurality of blades 1016 received with the respective blade slots 1132. An aligned pair of blade slots 1132 and associated fingers 1130 supports each blade 1016 in the blade set 1034 at two locations along each of the blades 1016.

The plurality of fingers 1130 extend away from the planar top portion 1112 to thereby engage each blade 1016 such that the fingers 1130 project through the blade set 1034 along the blades 1016. The blade support 1110 is removably coupled to the blade set 1034 such that the blade support 1110 can be uncoupled from the blade set 1034 during blade set 1034 replacement.

Referring back to FIGS. 6 and 7, the base 1014 includes at support tower 1054 that extends upwards from the base 1014 and ends in a plurality of fins 1056. Each of the fins 1056 are separated by a slot 1057 which are each configured to receive a blade 1016 of the blade set 34 therein. The support tower 1054 is arranged with a corresponding number of slots 1057 for each of the blades 1016 in the blade set 1034 to be used therewith. In an exemplary embodiment, the support tower 1054 includes at least as many slots 1057 (and fins 1056 between the slots 1057) as there are blades 1016 in the blade set. In an additional embodiment, the support tower 1054 may include more slots 1057. The slots 1057 represent a small increment or slice size and a corresponding blade set 1034 may include fewer blades 1016 than the available slots 1057. In an example, slots 1057 may be spaced apart at ¼ inch increments and may exemplarily be used with blade set with blades spaced ¼ inch or ½ inch apart. In still further exemplary embodiments, the fins and blades may be spaced 3/16 or ⅛ inch apart. However, a person of ordinary skill in the art will recognize other slicing dimensions as may be achieved with exemplary embodiments as disclosed herein. The fins 1056 are configured to support and retain the piece of food to be sliced, exemplarily a tomato, before, during and after it is sliced by the blades 1016 secured within the head 1012. The support tower 1054 is exemplarily oval or oblong in shape, however, it will be recognized that other shapes of support towers 1054 may be used in other embodiments. The target ring 1022 includes a lower portion 45 which is generally cylindrical in shape. The lower portion 1045 is dimensioned to slidingly engage around the support tower 1054. It will be recognized that the support tower 1054 of the base 1014 and the lower portion 1045 of the target ring 1022 of the head 1012 may be a variety of corresponding shapes, e.g. circular, oval, elliptical, rectangular, or other shapes as will be recognized by a person of ordinary skill in the art. The lower portion 45 may be a cylinder of the shape corresponding to the shape of the support tower 1054. The hole 1021 in the lid 1020 of the head 1012 may also be a corresponding shape to the lower portion 1045 and the support tower 1054. The support tower 1054 may further include tower ridges 1058 that are engaged by tower grooves 1060 on the interior of the lower portion of the target ring 1022, which is exemplarily depicted in FIG. 9. The lower portion 1045 of the target ring 1022 similarly may include tower ridges 1061 (FIG. 11), and the support tower 1054 may include tower grooves 1063 (FIG. 10). The tower ridges 1061 may slidingly engage the tower grooves 1063 for similar alignment purposes.

The base 1014 further includes a lip 1062 and a rounded elevation 1064 that define a trough 1066. The trough 1066 collects juice, exemplarily from tomatoes as they are sliced by the slicer 10, and channels the juice away from the head 1012 and support tower 1054.

In an embodiment, the fins 1056 include a depression or food retaining area 1068 that is configured to retain the piece of food to be cut by the slicer 10. In exemplary embodiments, the food retaining area 1068 may be shaped to retain a tomato, onion, cucumber, or hard boiled egg. In other embodiments, the food retaining area 1068 may be more generalized in shape. In embodiments, the food retaining area 1068 is formed by a plurality of curves shaped into the ends of the fins 1056. In an embodiment each fin 1056 is shaped differently from an adjacent fin to create the food retaining area 1068 of the desired shape. In an embodiment, the fins 1056 further have a curved profile apart from any food retaining area 1068 formed therein. In an exemplary embodiment, the fins 1056 have a concave curve across the horizontal (or longer) dimension (FIG. 6) while the fins 1056 have a convex curve across the depth (or shorter) dimension (FIG. 7).

In an exemplary use of the slicer 10 as disclosed herein, the user places a piece of produce to be sliced in the food retaining area 1068 in the fins 1056 of the support tower 1054. The user grips the head 1012 by the handles 1015 and centers the lower portion 1045 of the target ring 1022 over the support tower 1054. It is to be noted that the head 1012 and the blades 1016 may be directional and therefore either 180 degree rotation of the head 1012 can be used relative to the base 1014. The respective tower ridges 1058, 1061 and tower grooves 1060, 1063 located in the target ring 1022 and the support tower 1054 respectively maintain even alignment of the head 1012 relative to the base. A continuous quick downward motion pushes the blades of the head through the piece of produce to be cut. The head 1012 stops when the lower portion 1045 engages the base 1014. The sliced produce can then be removed off of the support tower 1054 and the head 1012 removed from engagements with the base 1014 for cutting the subsequent piece of produce.

The shape of the head and the base, as well as placement of draining holes in the head, promotes cleaning of the head without removal of the blade set. This is a further advantage as the blade set may not be removed from the head accept for instances of replacing the blade set.

During blade set 1034 replacement, the lid 1020 is removed from the blade cover 1018. The lid 1020 is removed by deforming one of the arms 1028 and fingers 1030 of the lid 1020 from out of engagement with the lip 1031 provided by the undercut 1032 in the blade cover 1018. The blade support 1110 is removed from engagement with the blade set 1034. The safety comb 1036 is secured over the blades 1016 of the blade set 1034 and used to prevent user contact with the blades 1016 and particularly with the cutting side of the blades 1016.

In still further exemplarily embodiments, the blade support as described above with respect to FIG. 5 may be used in accordance with an embodiment of the slicer 1000 described with respect to FIGS. 6-10. In such an exemplarily embodiment, the blade support may extend in the direction of the blade set 1034 from the target ring 1022. The blade support may include a plurality of fingers with slot defined therebetween to receive blades 1016 of the blade set 1034 therebetween. In an exemplary embodiment, because the blade support extends in the direction of the blade set 1034 from the target ring, the target area on the plurality of blades 1016 to slice the produce and to receive at least a portion of the fins 1056 of the support tower 1054 therethrough remains unobstructed for operation as described.

Figure 13:
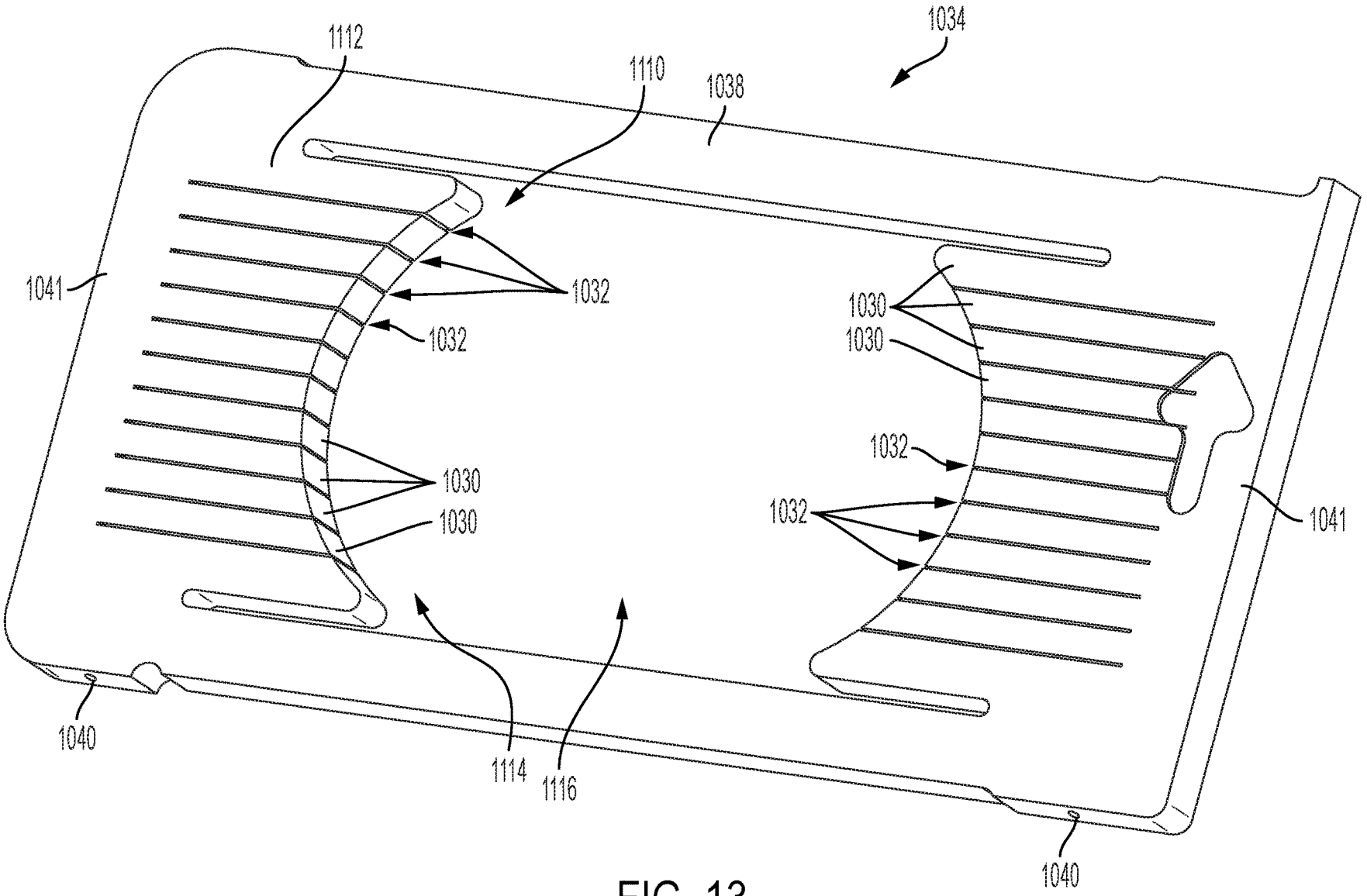
FIG. 13 is an exemplary embodiment of a blade set frame.

FIG. 13 depicts an exemplary embodiment of a frame 1038 of a blade set 1034 that includes the blade support 1110 integrally formed as part of the frame 1038 (note the blades 1016 are not shown in FIG. 13). That is, the blade support 1110 is integral with the frame 1038 of the blade set 1034.

As is described above with respect to FIG. 8, the frame 1038 includes frame bars 1041 between which the plurality of blades (1016 FIG. 8) are secured. The blades are secured to the frame bars 1041 of the frame 1038 with a pins 1040 that respectively extend through the frame bars 1041 and the ends of each of the blades 1016. In an exemplary construction, the frame 1038 is placed under a compressive force and, the blades inserted into the frame bars 1041, and the pins 1040 inserted through the frame bars 1041 and the ends of the blades. When the compressive force is relieved, the frame 1038 returns to its original shape and tension is placed on the blades.

In the embodiment of the blade support 1110 depicted in FIG. 13, the frame 1038 includes a plurality of fingers 1130 that extend interior of the frame from the respective frame bars 1041. A comparison between FIG. 8 and FIG. 13 show that while, for example in FIG. 8, the blades extend outward through the frame bars 1041 interior of the frame 1038, this is a nominal distance and does not provide the blade support recognized by the present inventors. In FIG. 13, the plurality of fingers 1130 of the blade support 1110 extend from the frame bars 1041 interior of the frame 1038 along the blades (not depicted). Each of the finger 1130 is separated from an adjacent finger 1130 by a respective blade slot 1132. Each of the blade slots 1132 receives a blade 1016 therebetween after the blade exits the frame bar 1041. Each of the fingers 1130 extends along at least a portion of respective blades into the interior of the frame 1038. The blade support 1110 exemplarily operates to provide lateral support to each blade against deflection with the adjacent fingers 1130 during slicing. In an exemplary embodiment, the plurality of fingers 1130 of the blade support 1110 are shaped to form the target ring 1114 to thereby define the target area 1116. In another embodiment, the fingers 1130 extend into the interior of the frame 1038 from the respective frame bars 1041, but terminate in a relationship or orientation alternative to defining the target area 1116.

Figure 14:
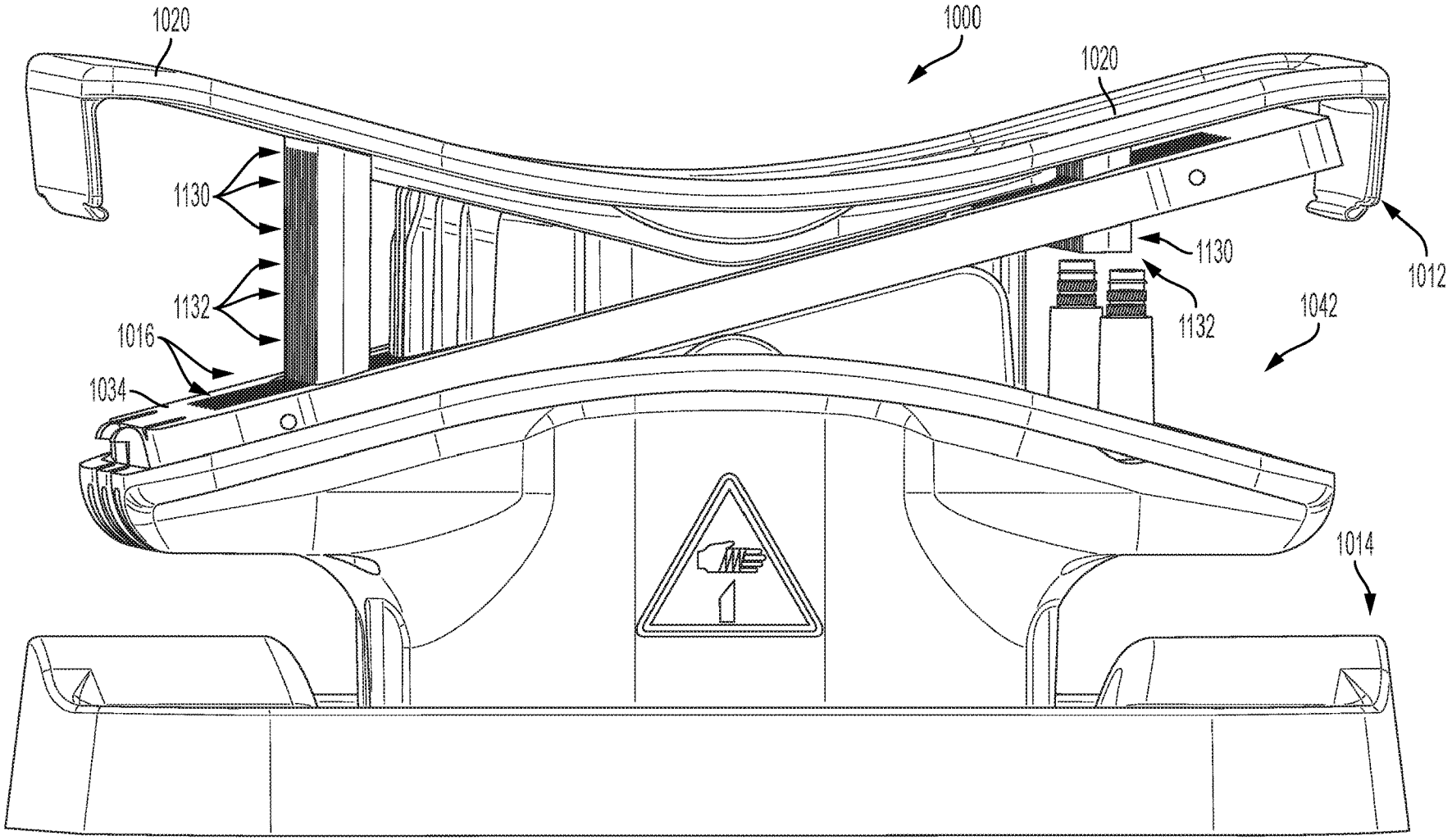
FIG. 14 is a perspective view of an alternative embodiment of the slicer in a closed position, although without the sidewalls to expose the interior space of the slicer.

FIG. 14 depicts another exemplary embodiment of the produce slicer 1000. The slicer 1000 depicted in FIG. 14 is similar to the exemplary embodiment of the slicer 1000 depicted in FIGS. 6 and 7 can comprise any of the components and/or features described with reference to FIGS. 6 and 7.

The slicer 1000 depicted in FIG. 14 exemplarily includes an exemplary blade support 1110 coupled to the lid 1020 such that the plurality of fingers 1130 of the blade support extend from the lid 1020 toward the blade set 1034 (note the sidewalls 1017 are removed to expose the interior space 1042). The plurality of fingers 1130 are separated by blade slots 1132 which receive a blade 1016 of the blade set 1034. The plurality of fingers 1130 extend through the blade set 1034. The plurality of fingers 1130 exemplarily support the plurality of blades 1016 received, and the blades 1016 in the blade set 1034 are supported by the plurality of fingers 1130 at two locations along each of the blades 1016. In such an exemplarily embodiment, the blade support extend in the direction of the blade set 1034 from the target ring 1022. While the embodiment depicted in FIG. 14 configures the fingers 1130 in a linear arrangement on either side of the target area 1116, in other embodiments, the fingers 1130 may be arranged to further correspond to or complement the target area 1116 of the blade set 1034 within the slicer 1000.

Embodiments of the slicer as disclosed herein provide numerous advantages and features. The support tower holds the piece of food (e.g. tomato) at an elevated position and the food retaining area in the support tower holds the tomato in a position to resist movement as it is sliced. The engagement between the target ring 1022 and the support tower 1054 as well as the alignment features in the tube and support tower ensure that the blades of the head are moved through the tomato to slice the tomato in a consistent and repeatable manner use after use. The top of the support tower is arranged to generally coincide with the top of the cover of the head and the sliced tomato generally remains in place on the support tower after cutting, therefore no additional tray or transfer pan is required for collection of the sliced food. The spaces of the support tower between the fins, in embodiments, are generally convex in shape and the base is further shaped to direct juices away from the cutting area and exemplary into the troughs of the base. This keeps the cutting area free from standing juice, which further facilitates cutting and collection of the cut tomato. The head encloses the blades such that the operator is not exposed to the sharp sides of the blade and holds the blades at an angle to facilitate improved cutting through the tomato. Use of the safety comb as disclosed and described above provides a slicing system wherein the blades may be installed and removed as a blade set in a safe manner by preventing contact between the user and any sharp edges of the blades while also providing a tool that ensures that the blade set is properly installed and held in place before the safety comb can be removed. In a removal operation, the safety comb overcomes the retention features of the head such that the blade set is prevented from being removed without installation of the safety comb.

As previously described above, while not depicted herein, it is recognized that slicers may be configured to perform other types of food slicing, including, but not limited to dicing, cubing, slicing, or wedging. In an exemplary embodiment, a blade cartridge configured to perform a wedge cut, may include exemplarily six or eight angled blades radially extending from a central alignment rod with corresponding wedge-shaped fins on the pusher head. In such an embodiment, the central alignment rod and an exemplary support ring may form the frame for the blade set. In exemplary embodiments, the blades of the blade set may exemplarily be located at different vertical positions relative to one another, which may further reduce cutting surface area. In one embodiment, this may be achieved by two separate blade sets, or a single blade set with blades on different height levels. A non-limiting example of an exemplary construction of a wedging blade is exemplarily found in the 908-A series of heavy-duty wedgers available from Prince Castle LLC.

It will be recognized that the present disclosure has made reference to a plurality of exemplary embodiments. It will be recognized by a person of ordinary skill in the art in view of the present disclosure that various features and components as described in connection with one embodiment may be similarly applied or incorporated with the features of another embodiment disclosed herein, while remaining within the scope of the present disclosure.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A blade assembly for use with a produce slicer, the blade assembly comprising:

a first blade set having a first pair of opposing frame bars and a plurality of blades extending between the first pair of opposing frame bars;

a blade cover positioned relative to the first blade set, the blade cover includes a first target ring that defines a first target area on the plurality of blades of the first blade set through which a piece of produce passes during slicing; and a blade support extending through at least a portion of the blade set from at least a portion of the first target ring to support the plurality of blades;

wherein the blade support comprises a plurality of fingers separated by a plurality of blade slots, and each blade of the plurality of blades is positioned within a blade slot of the plurality of blade slots for lateral engagement of the blades against the fingers of the blade support at two locations along each blade of the plurality of blades.

2. A blade assembly for use with a produce slicer, the blade assembly comprising:

a first blade set having a first pair of opposing frame bars and a plurality of blades extending between the first pair of opposing frame bars;

a blade cover positioned relative to the first blade set, the blade cover includes a first target ring that defines a first target area on the plurality of blades of the first blade set through which a piece of produce passes during slicing, wherein the blade cover has a plurality of sides extending away from the planar top portion such that the planar top portion and the plurality of sides define an open interior; and a blade support extending through at least a portion of the blade set from at least a portion of the first target ring to support the plurality of blades, the blade support includes a plurality of fingers separated by a plurality of blade slots defined in the blade support and the plurality of blades are disposed in the plurality of blade slots such that the plurality of fingers extend between the plurality of blades for lateral engagement of the blades against the fingers of the blade support;

wherein the blade set is positioned in the open interior; and wherein the blade support extends from the first target ring into the open interior.

3. The blade assembly of claim 2, wherein the blade assembly further comprises a second blade set positioned relative to the first blade set and having a second pair of opposing frame bars and a plurality of blades extending between the second pair of opposing frame bars, wherein the plurality of blades of the first blade set are offset from the plurality of blades of the second blade set.

4. The blade assembly of claim 3, wherein the blade supports extend from the first target ring to engagingly support the blades of the first blade set and the blades of the second blade set.

5. A blade assembly for use with a produce slicer, the blade assembly comprising:

a first blade set having a first pair of opposing frame bars and a plurality of blades extending between the first pair of opposing frame bars;

a blade cover positioned relative to the first blade set, the blade cover includes a first target ring that defines a first target area on the plurality of blades of the first blade set through which a first piece of produce passes during slicing, the blade cover has a second target ring that defines a second target area through which a second piece of produce passes during slicing;

a first blade support extending from at least a portion of the first target ring through a first portion of the blade set between the plurality of blades for lateral engagement of the plurality of blades against the first blade support; and a second blade support extending from at least a portion of the second target ring through a second portion of the blade set between the plurality of blades for lateral engagement of the plurality of blades against the second blade support about the second target area.

6. The blade assembly of claim 5, wherein the first blade support and the second blade support each blade at four locations along the blades.

7. A blade assembly for use with a produce slicer, the blade assembly comprising:

a first blade set having a first pair of opposing frame bars and a plurality of blades extending between the first pair of opposing frame bars;

a blade cover positioned relative to the first blade set, the blade cover includes a first target ring that defines a first target area on the plurality of blades of the first blade set through which a piece of produce passes during slicing; and a blade support extending from at least a portion of the first target ring, the blade support comprising, the blade support comprises a plurality of fingers extending from the blade cover through the first blade set between the plurality of blades of the first blade set for lateral engagement of the blades against the fingers of the blade support.

8. The blade assembly of claim 7, wherein each finger of the plurality of fingers is separated from an adjacent finger by a blade slot of a plurality of blade slots.

9. The blade assembly of claim 8, wherein each blade of the plurality of blades of the first blade set is engaged within a respective blade slot of the plurality of blade slots and laterally engaged by the adjacent fingers separated by the respective blade slot.

10. The blade assembly of claim 9, wherein each blade of the plurality of blades of the first blade set is engaged with a first respective blade slot and a second respective blade slot of the plurality of blade slots and laterally engaged by adjacent fingers separated by the first respective blade slot and adjacent fingers separated by the second respective blade slot.

11. The blade assembly of claim 7, wherein each finger of the plurality of fingers laterally engages at least one blade of the plurality of blades to support the at least one blade of the plurality of blades against lateral deflection of the at least one blade during slicing.

12. A slicer comprising:

a frame comprising a blade assembly receiving area and a head receiver;

a blade assembly removably received within the blade assembly receiving area, the blade assembly comprising:

a first blade set, the first blade set comprising a first frame bar and a second frame bar, and a plurality of blades extending therebetween;

a blade cover positioned relative to the first blade set, the blade cover includes a planar top portion having a first target ring that defines a first target area configured to receive a piece of produce to be sliced and the blade cover comprising a bottom portion positioned proximate the first blade set; and a blade support extending from the bottom portion of the blade cover and at least a portion first target ring through the first blade set between the plurality of blades for lateral engagement of the blades against the blade support to support each blade of the plurality of blades at two locations along the blades; and a pusher head removably received within the head receiver, the pusher head comprising a pusher head body and a first produce pusher with a plurality of fins extending in a direction away from the pusher head body, the first produce pusher aligned with the first target ring.

13. A slicer comprising:

a frame comprising a blade assembly receiving area and a head receiver;

a blade assembly removably received within the blade assembly receiving area, the blade assembly comprising:

a first blade set, the first blade set comprising a first frame bar and a second frame bar, and a plurality of blades extending therebetween;

a blade cover positioned relative to the first blade set, the blade cover includes a planar top portion having a first target ring that defines a first target area configured to receive a piece of produce to be sliced, the blade cover has a plurality of sides extending away from the planar top portion such that the planar top portion and the plurality of sides define an open interior, and the first blade set is positioned in the open interior; and a blade support extending from at least a portion of the first target ring into the open interior to support the plurality of blades, wherein the blade support includes a plurality of fingers separated by a plurality of blade slots defined in the blade support and each blade of the plurality of blades is positioned within a blade slot of the plurality of blade slots such that the fingers extend between the blades for lateral engagement of the blades against the fingers of the blade support; and a pusher head removably received within the head receiver, the pusher head comprising a pusher head body and a first produce pusher with a plurality of fins extending in a direction away from the pusher head body, the first produce pusher aligned with the first target ring.

14. The slicer of claim 13, wherein the blade assembly further comprises a second blade set positioned relative to the first blade set and the second blade set comprises a third frame bar and a fourth frame bar and a plurality of blades extending therebetween, the plurality of blades of the first blade set are offset from the plurality of blades of the second blade set, and each blade of the plurality of blades of the second blade set is positioned within a blade slot of the plurality of blades slots such that the fingers extend between the blades of the second blade set for lateral engagement of the blades of the second blade set against the fingers of the blade support.

15. A slicer comprising:

a frame comprising a blade assembly receiving area and a head receiver;

a blade assembly removably received within the blade assembly receiving area, the blade assembly comprising:

a first blade set, the first blade set comprising a first frame bar and a second frame bar, and a plurality of blades extending therebetween;

a blade cover positioned relative to the first blade set, the blade cover includes a planar top portion having a first target ring that defines a first target area configured to receive a first piece of produce to be sliced, and the blade cover has a second target ring that defines a second target area configured to receive a second piece of produce to be sliced;

a first blade support extending from at least a portion of the first target ring through the first blade set between the plurality of blades for lateral engagement of the blades against the blade support to support the plurality of blades; and a second blade support extending from at least a portion of the second target ring through the first blade set between the plurality of blades for lateral engagement of the blades against the blade support to support the plurality of blades; and a pusher head removably received within the head receiver, the pusher head comprising a pusher head body and a first produce pusher with a plurality of fins extending in a direction away from the pusher head body, the first produce pusher aligned with the first target ring.

16. The slicer of claim 15, wherein the first blade support provides lateral engagement at two locations of the each of the blades against the blade support and the second blade support provides lateral engagement at two further locations of the blades against the blade support.

* * * * *